US007837299B2

(12) United States Patent
Mori

(10) Patent No.: US 7,837,299 B2
(45) Date of Patent: Nov. 23, 2010

(54) LIQUID EJECTING HEAD AND METHOD OF MANUFACTURING THE SAME, IMAGE FORMING APPARATUS, LIQUID DROP EJECTING DEVICE, AND RECORDING METHOD

(75) Inventor: Takashi Mori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1033 days.

(21) Appl. No.: 11/603,744

(22) Filed: Nov. 22, 2006

(65) Prior Publication Data

US 2007/0115323 A1 May 24, 2007

(30) Foreign Application Priority Data

Nov. 24, 2005 (JP) ..... 2005-338130
Feb. 1, 2006 (JP) ..... 2006-025085

(51) Int. Cl.
*B41J 2/135* (2006.01)

(52) U.S. Cl. ..... 347/45; 347/47

(58) Field of Classification Search ..... 347/45–47, 347/5, 9, 41
See application file for complete search history.

(56) References Cited

U.S. PATENT DOCUMENTS 6,109,728 A * 8/2000 Kakuda et al. ..... 347/45
6,402,296 B1 6/2002 Cleland et al.
7,267,426 B2 * 9/2007 Miyajima et al. ..... 347/45
2003/0198899 A1 10/2003 Ohkuma
2005/0035999 A1 2/2005 Kitahara et al.

FOREIGN PATENT DOCUMENTS

| | | |
|---|---|---|
| EP | 1506869 | 2/2005 |
| EP | 1564000 | 8/2005 |
| JP | 8-25630 | 1/1996 |
| JP | 11-268278 | 10/1999 |
| JP | 2001-232799 | 8/2001 |
| JP | 3379119 | 12/2002 |
| JP | 2003-19803 | 1/2003 |
| JP | 2003-72085 | 3/2003 |
| JP | 2003-72086 | 3/2003 |

OTHER PUBLICATIONS

Mar. 19, 2007 European Search Report in connection with European patent application EP 06 25 6005.
Mar. 9, 2009 European official action in connection with a counterpart European patent Application No. 06 256 005.7.

* cited by examiner

*Primary Examiner*—Thinh H Nguyen
(74) *Attorney, Agent, or Firm*—Cooper & Dunham LLP

(57) ABSTRACT

A liquid ejecting head with a nozzle forming member in which plural nozzle sequences formed by aligning nozzles configured to eject a liquid drop of recording liquid are arranged such that nozzles of respective sequences are provided in a zigzag pattern and a water-repellent layer comprising a resin layer is applied and formed on a surface thereof at a side of liquid drop ejection, is provided, wherein the respective nozzle sequences are arranged at an interval(s) which is/are not greater than a diameter of a nozzle.

17 Claims, 11 Drawing Sheets

LIQUID EJECTING HEAD AND METHOD OF MANUFACTURING THE SAME, IMAGE FORMING APPARATUS, LIQUID DROP EJECTING DEVICE, AND RECORDING METHOD

BACKGROUND

1. Technical Field

This disclosure relates to a liquid ejecting head and a method of manufacturing the same, an image forming apparatus, a liquid drop ejecting device, and a recording method.

2. Description of the Related Art

As an image forming apparatus such as a printer, a facsimile, a copying machine, and a composite machine thereof, for example, an ink jet recording apparatus is known. Such an ink jet recording apparatus conducts recording (for example, image formation, image printing, character printing, and printing may be used as synonyms.) by using a liquid ejecting head as a recording head and by ejecting an ink drop as recording liquid onto a medium to be recorded such as a recording paper (hereinafter, it may be called a "paper sheet", the material of which is not limited to paper, and it may be also called a recording medium, a transfer paper, a transfer material and a material to be recorded).

Meanwhile, since a liquid ejecting head is of conducting recording by ejecting a liquid drop from a nozzle thereof, the form or precision of the nozzle greatly influences the ink liquid jetting performance. Further, it is known that the properties of the surface of a nozzle forming member for forming a nozzle hole also influences the ink drop jetting performance. For example, when ink adheres to the peripheral portion of the nozzle hole on the surface of the nozzle forming member and ununiform ink pool is formed, it is known that a disadvantage is caused of, for example, bending the direction of ejecting ink, making the sizes of ink drops be ununiform, or making the traveling speed of an ink drop be unstable.

Therefore, in a liquid ejecting head, for example, an ink-repellent layer (film) or a water-repellent layer is generally formed on the surface at the side of liquid drop ejection.

For example, JP-A-2001-232799, JP-A-2003-072085, JP-A-2003-072086, and JP-A-08-025630 disclose the formation of a fluorine-containing water-repellent film, formation of a water-repellent film of hexamethyldisiloxane, etc., by means of plasma polymerization, the formation of a water-repellent film such as fluororesin polymerization films and silicone resin polymerization films, and the formation of a hydrophilic film and water-repellent film, respectively.

Also, as a method for forming a water-repellent film, JP 3379119 discloses a method for applying a water-and-oil-repellent film by dipping the surface of a nozzle into a solution in which a water-and-oil-repellent material is dissolved while a condition of emitting gas from the back side of the nozzle to the surface thereof is maintained and subsequently taking the nozzle surface away from the solution and leaving it while the gas is emitted.

As described above, for a head using a fluororesin for a water-repellent layer, specifically, there is used, for example, a method for forming a thin film of PTFE by subjecting the surface of a metal nozzle plate to eutectoid plating and heating treatment, and a method for applying a fluorine-containing water repellency agent on the surface of a nozzle plate (substrate) made of a metal or a resin.

In the case of such a nozzle forming member whose a water-repellent layer is made of a fluororesin, it is possible to provide a good water repellency (ink repellency) by a publicly known dye ink or pigment ink with a surface tension greater than 30 mN/m.

However, in an experiment conducted by the inventor, it was found that there is a problem of exhibiting no sufficient water repellency (ink repellency) in the case of using an ink with a low surface tension of 30 mN/m or less or an ink containing a fluorine containing compound.

On the other hand, as described above, for a head using a silicone resin coating as a water-repellent film, specifically, there has been applied, for example, a method for vacuum-depositing a liquid silicone resin material or a method for forming a silicone oil by means of plasma polymerization.

However, when such a method for forming a silicone resin coating is used, vacuum processing is needed at the time of film formation, and therefore, the equipment is large which causes the cost to be high. Also, since the time period for film formation is long and a formed coating is very thin in the vacuum deposition and plasma polymerization, a defect such as a pinhole is easily generated. Further, in a method such as vacuum deposition and plasma polymerization, a problem may occur such that it is difficult to thicken the silicone resin coating and it is difficult to keep the sufficient durability of a nozzle surface (the surface of a nozzle forming member at the side of liquid drop ejection) against wiping thereof which is performed in a head maintenance and recovery operation or ink.

Further, as disclosed in JP 3379119 described above, in the method for forming an ink-repellent layer on the surface of a nozzle plate by dipping the nozzle plate into a solution in which a ink repellency agent is dissolved while gas is jetted from a nozzle hole, air bubbles are generated in the solution since the dipping into the solution is made while the gas is jetted. Therefore, when the solution is cured at ordinary temperature, there may be a problem such that it is necessary to leave the solution in the atmosphere and it is difficult to keep the condition of the solution so that the film thickness of an ink repellency layer cannot be controlled due to the change of the solution viscosity.

Herein, the inventor has already invented a method for forming a water-repellent layer by uniformly applying a liquid silicone resin on only a desired portion of the surface of a nozzle forming member using a dispenser. In this case, in order to apply an ordinary temperature-curing type silicone resin, it is necessary to prevent the resin from entering the inside of the nozzle, and therefore, it is necessary to adopt, for example, a countermeasure such that air is jetted from the nozzle to the outside thereof or a removable protecting member is embedded in the nozzle. Accordingly, the simplification of a coating process may become a new problem.

In such a situation, the inventor have found to provide a liquid ejecting head, a method of manufacturing the same, an image forming apparatus, a liquid drop ejecting device, and a recording method, any of which makes it possible to simplify a process for coating with a resin layer.

SUMMARY

According to one aspect of this disclosure, there is provided a liquid ejecting head with a nozzle forming member in which plural nozzle sequences formed by aligning nozzles configured to eject a liquid drop of recording liquid are arranged such that nozzles of respective sequences are provided in a zigzag pattern and a water-repellent layer comprising a resin layer is applied and formed on a surface thereof at a side of liquid drop ejection, characterized in that the respective nozzle sequences are arranged at an interval(s) which is/are not greater than a diameter of a nozzle.

According to another aspect of this disclosure, there is provided a liquid ejecting head with a nozzle forming member in which plural nozzle sequences formed by aligning nozzles configured to eject a liquid drop of recording liquid are arranged and a water-repellent layer comprising a resin layer is applied and formed on a surface thereof at a side of liquid drop ejection, characterized in that the respective nozzle sequences are arranged at an interval(s) which is/are equal to or greater than 100 μm.

According to another aspect of this disclosure, there is provided a method of manufacturing a liquid ejecting head as described above, characterized in that a resin layer is applied on the nozzle forming member in atmosphere.

According to another aspect of this disclosure, there is provided an image forming apparatus with a liquid ejecting head configured to eject a liquid drop of recording liquid, characterized by comprising a liquid ejecting head as described above.

According to another aspect of this disclosure, there is provided a liquid drop ejecting device configured to eject a liquid drop from a liquid ejecting head, characterized by comprising a liquid ejecting head as described above.

According to another aspect of this disclosure, there is provided a recording method characterized in that recording is performed on a recording medium by ejecting a liquid drop of recording liquid from a liquid ejecting head as described above.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Embodiments of the present invention are described below, with reference to the accompanying drawings.

Figure 1:
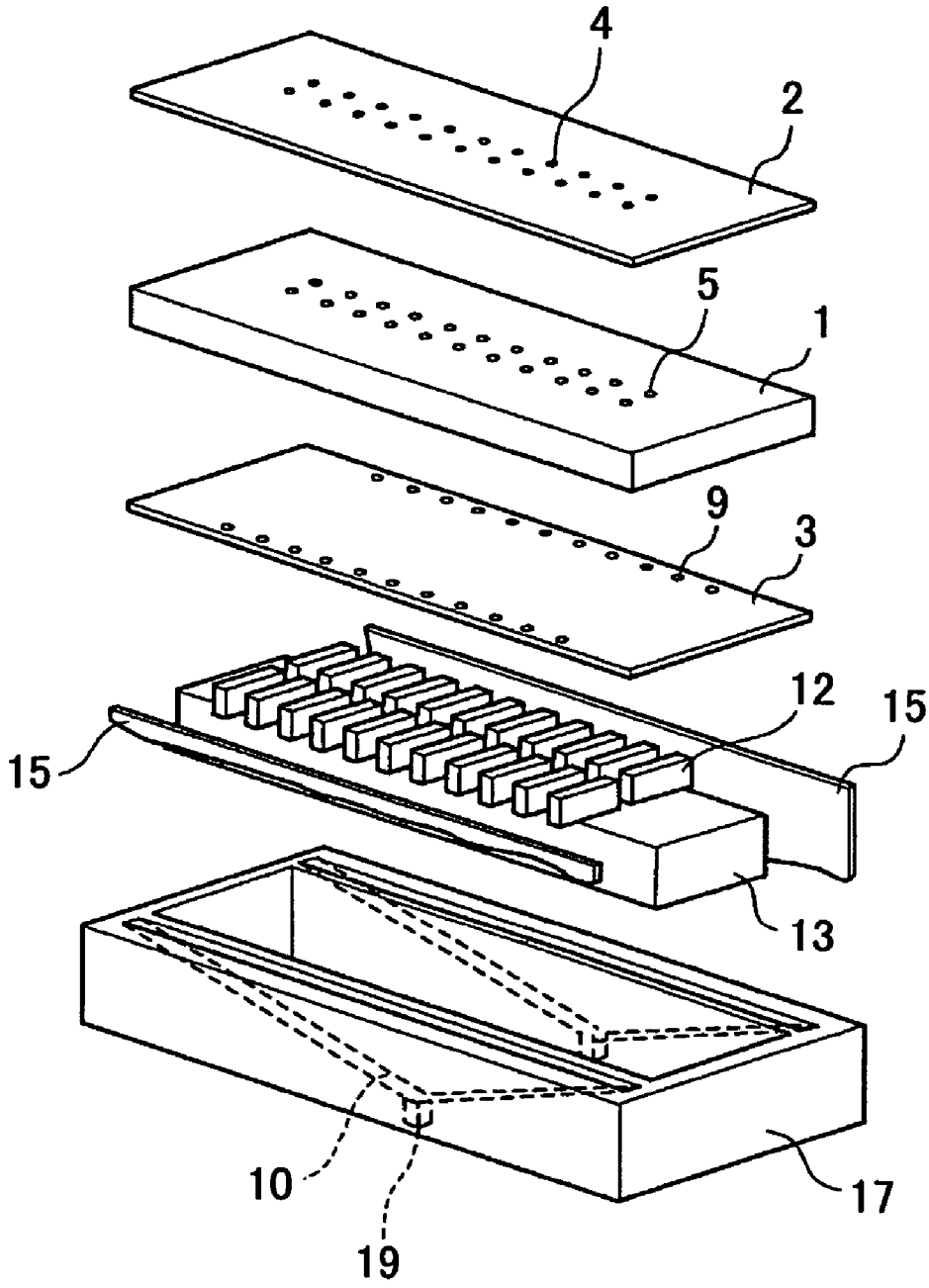
FIG. 1 is an exploded perspective diagram showing one example of a liquid ejecting head according to the present invention.
Figure 2:
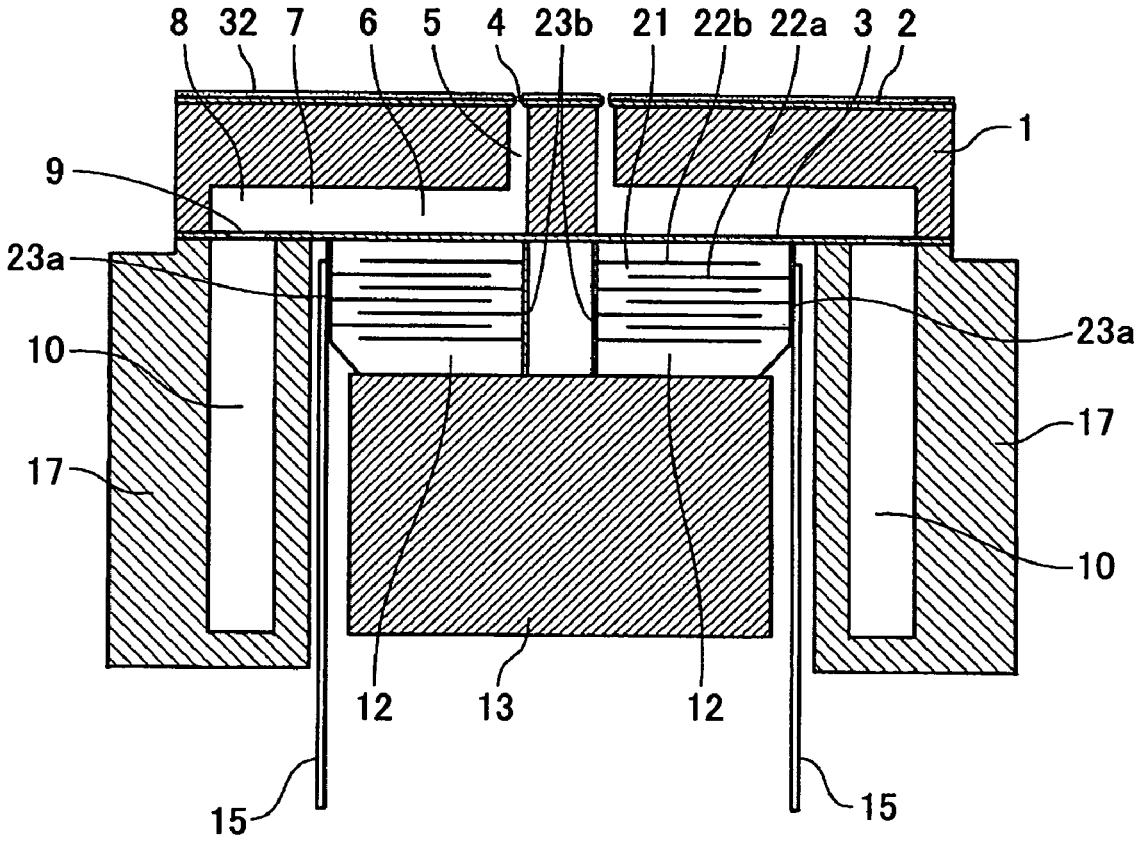
FIG. 2 is a cross-sectional diagram illustrating the head along the longitudinal directions of a liquid chamber.
Figure 3:
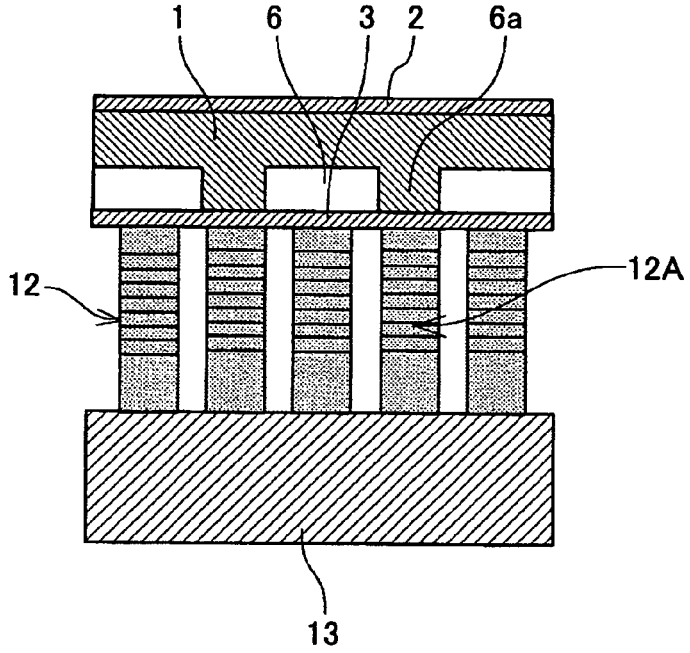
FIG. 3 is a cross-sectional diagram illustrating a bi-pitch structure of the head along the lateral directions of a liquid chamber.

A liquid ejecting head of the first embodiment according to the present invention is described with reference to FIGS. 1 to 4. Herein, FIG. 1 is an exploded perspective diagram of the head, FIG. 2 is a cross-sectional diagram illustrating the head along the longitudinal directions of a liquid chamber, and FIG. 3 is a cross-sectional diagram illustrating the head along the lateral directions of the liquid chamber.

The liquid ejecting head has a flow channel plate 1 which is made of, for example, a single crystal silicon substrate, a nozzle plate 2 which is a nozzle forming member jointed to the upper surface of the channel plate 1, and a vibrating plate 3 which is jointed to the lower surface of the channel plate 1, whereby a pressurized liquid chamber 6 communicating a nozzle 4 for ejecting a liquid drop via a communicating channel 5, a fluid resistance part 7, and a communication part 8 communicating with the liquid chamber 6 via the fluid resistance part 7 are formed and recording liquid (for example, ink) is supplied from a common liquid chamber 10 formed in a frame member 17 described below to the communication part 8 via a supply port 9 formed on the vibrating plate 3.

Then, the upper end face of a laminate-type piezoelectric element 12 as a driving element (such as an actuator device and a pressure generating device) which corresponds to each pressurized liquid chamber 6 is jointed to the outer surface of the vibrating plate 3 having a member which constitutes the wall surface of the liquid chamber 6 (the surface at the opposite side of the liquid chamber 6) via a communication part which is formed on the vibrating plate 3 and is not shown in the figures. Also, the lower end face of the laminate-type piezoelectric element 12 is jointed to a base member 13.

Herein, the piezoelectric member 12 is obtained by alternately laminating a piezoelectric material layer 21 and an inner electrode 22*a* or 22*b* and generates a displacement in laminating directions by connecting the end faces of the extending inner electrodes 22*a* and 22*b* to the end face electrodes (external electrodes) 23*a* and 23*b*, respectively, and applying a voltage between the end face electrodes 23*a* and 23*b*.

Then, a FPC cable 15 is connected by means of solder joining, ACF (anisotropic conductive film) joining or wire bonding in order to supply a driving signal to the piezoelectric element 12, and a driving circuit (driver IC) which is not shown in the figures and provided for selectively applying a driving waveform to each piezoelectric element 12 is mounted on the FPC cable 15.

Figure 4:
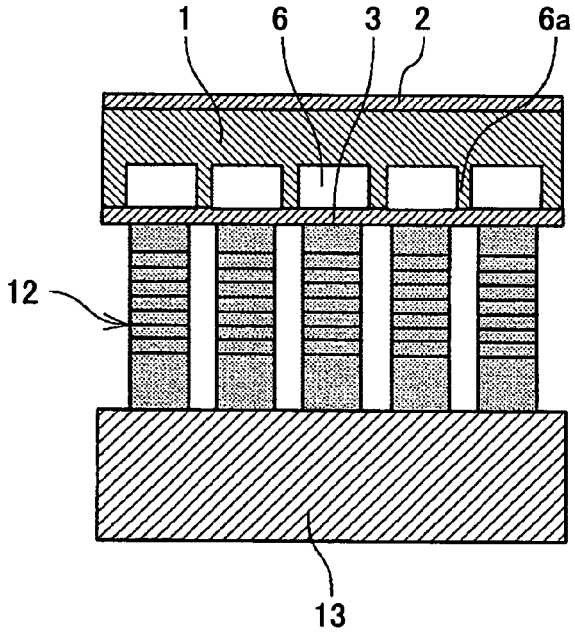
FIG. 4 is a cross-sectional diagram illustrating a normal-pitch structure of the head along the lateral directions of a liquid chamber.

Additionally, in the lateral directions of the liquid chamber (in the directions of alignment of the nozzles 4), a bi-pitch structure in which the piezoelectric element 12 and a pillar part 12A are arranged alternately can be provided as shown in FIG. 3 or a normal pitch structure having no pillar part 12 can be provided as shown in FIG. 4.

In this head, ink in the liquid chamber 6 is pressurized by using a displacement in d33 directions as piezoelectric directions of the piezoelectric element 12, and further, a liquid drop is ejected in accordance with a side-shooter method in which the direction of ejecting a liquid drop is different from the direction of flow of recording liquid. Due to the use of the side shooter method, the size of the piezoelectric element 12 can approximately be the size of the head and the miniaturization of the piezoelectric element 12 directly leads to the miniaturization of the head, so that it is easily to attain the miniaturization of the head.

Further, a frame member 17 formed by injection molding of an epoxy resin or poly(phenylene sulfide) is jointed to the peripheral portion of an actuator part composed of the piezoelectric element 12, the base member 13, the FPC 15, etc. Then, while the common liquid chamber 10 described above is formed on the frame member 17, the supply port 19 for supplying recording liquid from the outside to the common liquid chamber 10 is formed and the supply port 19 is further connected to a recording liquid supply source such as a subtank and a recording liquid cartridge which are not shown in the figures.

Herein, the flow channel plate 1 provides a channel part constituting the communication channel 5, a through-hole being the pressurized liquid chamber 6, the fluid resistance part 7, the communication part 8, etc., by, for example, anisotropic-etching a single crystal silicon substrate with a crystallographic face orientation of (110) using an alkaline etching liquid such as an aqueous solution of potassium hydroxide (KOH). Additionally, the pressurized liquid chamber is separated by a partition wall 6*a*.

The nozzle plate 2 is formed from a metal plate of nickel (Ni) and manufactured by an electroforming (electrocasting) method. The nozzles 4 with a diameter of 10-35 μm which correspond to each pressurized liquid chamber 6 are formed on the nozzle plate 2 which is jointed to the flow channel plate 1 by using an adhesive. Then, a resin layer 32 constituting a water-repellent layer (the illustration of which is omitted in the FIG. 3 and FIG. 4) as described below is formed on a face of the nozzle plate 2 at the side of liquid drop ejection (a surface at the side of ejection: an ejection face or a face at the opposite side of the liquid chamber 6)

The vibrating plate 3 is formed from a metal plate of nickel (Ni) and manufactured by an electroforming (electrocasting) method. A part of the vibrating plate 3 which corresponds to the pressurized liquid chamber 6 is a thin part to be easily deformed and a central part thereof is provided with a connection part for connecting to the piezoelectric element 12 which part is not shown in the figures.

The piezoelectric element 12 is formed by jointing a laminate-type piezoelectric element member to the base member 13 and subsequently dividing it by application of a channel processing using, for example, a dicing saw. When the aforementioned bi-pitch structure in FIG. 3 is employed, the pillar part 12A is a piezoelectric element member formed by a channel processing but functions as a simple pillar since no driving voltage is applied.

In thus constructed liquid ejecting head, for example, when it is driven by a pushing and beating method, a driving pulse voltage of 20-50 V from a control part which is not shown in the figures is selectively applied to plural piezoelectric elements 2 according to an image to be recorded whereby the piezoelectric element 12 to which the pulse voltage is applied is displaced so as to deform the vibrating plate 3 to the direction of the nozzle plate 2, and liquid in the liquid chamber 6 is pressurized by the volume (capacity) change of the liquid chamber 6 so as to eject a liquid drop from the nozzle 4 of the nozzle plate 2. Then, the pressure of liquid in the liquid chamber 6 decreases with the ejection of a liquid drop, and a slight negative pressure caused by the inertia of the liquid flow generates in the liquid chamber 6 at this time.

In this situation, when the application of a voltage to the piezoelectric element 12 is turned off, the vibrating plate 3 returns to an original position thereof and the shape of the liquid in the liquid chamber 6 becomes the original one, thereby generating a further negative pressure. At this time, recording liquid from the common liquid chamber 10 is filled in the liquid chamber 6, and a liquid drop is ejected from the nozzle 4 according to the next application of a driving pulse.

Additionally, the liquid ejecting head can be driven by not only the aforementioned pushing and beating method but also another method such as a pulling and beating method (a method of pressurization due to a restoring force of the vibrating plate 3 released from a pulling state thereof) and a pulling, pushing and beating method (a method of keeping the vibrating plate 3 at an intermediate position, then pulling it from the position and pushing it).

Figure 5:
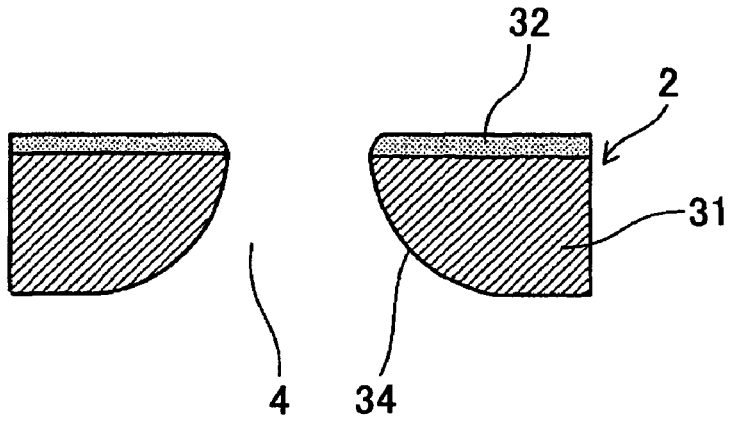
FIG. 5 is an enlarged cross-sectional diagram illustrating the essential part of a nozzle plate of the head.

Herein, the nozzle plate 2 which is a flow channel forming member in the liquid ejecting head is described with reference to FIG. 5.

The nozzle plate 2 is provided by applying and forming a resin layer 32 as a water-repellent layer on a surface of a nozzle substrate 31 at the side of ejection face which is a Ni metal plate on which a nozzle hole 34 providing a nozzle 4 is formed.

Herein, the nozzle plate 31 is described as, but not limited to, a Ni metal plate and there can be also used, for example, one obtained by perforating a resin material such as polyimides to provide a nozzle hole by means of excimer laser or a laminated-layer member composed of a metal material and a resin material. A nozzle plate with a high rigidity can be obtained by using a metal material for the nozzle substrate 31 and the adhesiveness thereof to a resin layer and the durability thereof can be improved by using a resin material.

The film thickness of the resin layer 32 is preferably 0.1 μm or greater and less than 1 μm, when the wiping-resistance thereof and the water repellency thereof or the influence thereof to the drop ejection are taken into consideration.

Also, when the resin layer 32 is formed by application thereof, the resin layer 32 is formed in a round shape in which the thickness thereof gradually increases toward the periphery of the nozzle 4. As the resin layer 32 is made in such a round shape at an aperture portion corresponding to the nozzle 4, a resin film 41 can be prevented from being caught by a wiper blade and removed when wiping is performed.

As a resin for forming the resin layer 32, ink-repellent materials are preferable and, for example, materials containing a fluorine-containing compound or a silicone resin are preferable. As a fluorine-containing resin, for example, PTFE, PFA, and ETFE have been known, and PTFE is preferable from the viewpoint of the ink repellency thereof. Also, when a fluorine-containing additive is contained in ink, resin films of dimethylsilicone are preferable.

As a specific water-repellent material, there can be provided, for example, organic compounds having a fluorine atom, particularly organic substances having a fluoroalkyl group, and organic silicon compounds having a dimethylsiloxane skeleton.

As a organic compound having a fluorine atom, for example, fluoroalkylsilanes, and alkanes, carboxylic acids, alcohols and amines which have a fluoroalkyl group are desirable. Specifically, there can be provided, as a fluoroalkylsilane, heptadecafluoro-1,1,2,2-tetrahydrodecyltrimethoxysilane and heptadecafluoro-1,1,2,2-tetrahydrotrichlorosilane;

as an alkane having a fluoroalkyl group, octafluorocyclobutane, perfluoromethylcyclohexane, perfluoro-n-hexane, perfluoro-n-heptane, tetradecafluoro-2-methylpentane, perfluorododecane and perfluoroicosane; as a carboxylic acid having a fluoroalkyl group, perfluorodecanoic acid and perfluorooctanoic acid; as an alcohol having a fluoroalkyl group, 3,3,4,4,5,5,5-heptafluoro-2-pentanol; and as an amine having a fluoroalkyl group, heptadecafluoro-1,1,2,2-tetrahydrodecylamine. As an organic compound having a dimethylsiloxane skeleton, there can be provided, for example, α,ω-bis(3-aminopropyl)polydimethylsiloxane, α,ω-bis(3-glycidoxypropyl) polydimethylsiloxane and α,ω-bis(vinyl)polydimethylsiloxane.

As another water-repellent material, organic compounds having a silicon atom, particularly organic compounds having an alkylsiloxane group, can be provided.

As an organic compound having an alkylsiloxane group, alkylsiloxane-containing epoxy resins can be provided which have an alkylsiloxane group and at least two cycloaliphatic epoxy groups in a molecule composing an alkylsiloxane-containing epoxy resin composition, and, for example, the following polymer compound (A) containing structural units represented by general formulas (a) and (b) can be provided.

(A)

(a)

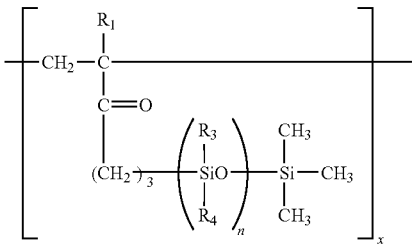

(b)

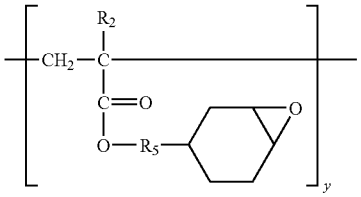

In the above formula, x=an integer of 1-50;

y=an integer of 2-100;

n=an integer of 2-100;

$R_1$ and $R_2$ is independently —H or —$CH_3$;

$R_3$ and $R_4$ is independently —$CH_3$ or —$C_6H_5$; and

R5 is —$CH_2$—, —$CH_2CH_2$—, or —$CH_2CH(CH_3)$—.

Compounds having such a structure described above also function as a binder when another water-repellent compound is used in combination. That is, a function of improving workability for a dried coating film can be also provided which function improves the suitability of application of a water-repellent composition and the drying property thereof after the evaporation of a solvent.

Also, since it has been found that no sufficient water repellency is obtained by using a fluororesin, when recording liquid containing a fluorine-containing compound is used in a liquid ejecting head, it is preferable to form a resin layer by using a silicone resin. The dynamic surface tension of the recording liquid can be 30 mN/m or less by containing a fluorine-containing compound therein and the penetration rate of ink into a paper sheet is increased by using a recording liquid with a low dynamic surface tension of 30 mN/m or less, whereby, particularly, there is provided an effect such that the reduction of drying time can be attained when a pigment-containing ink is used. Also, an image can be formed with a good color development by containing a fluorine-containing surfactant.

In order to easily form the resin layer 32 with a low cost, the material of a coating is preferably an ordinary temperature curing-type but may be an ultraviolet ray curing-type. For example, "SR2410" (commercial name) available from Dow Corning Toray Co. Ltd. or "KR400" (commercial name) available from Shin-Etsu Chemical Co. Ltd. can be used. Application in the atmosphere can be attained by using an ordinary temperature curing-type liquid silicone resin. Particularly, it is preferable to use a liquid silicone resin with a hydrolysis property.

The application of a resin to form the resin layer 32 is preferably performed in the atmosphere by a dispenser. A resin can be easily applied with inexpensive equipment by performing the it in the atmosphere and a necessary amount of resin can be easily applied on a necessary area by using a dispenser thereby attaining cost down.

Figure 6:
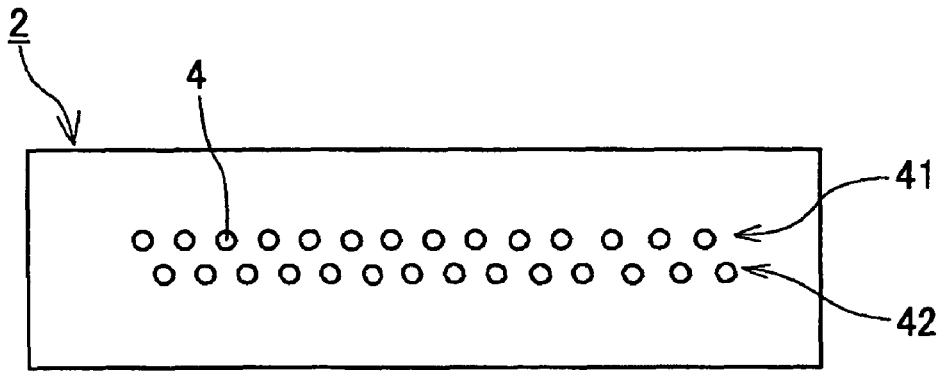
FIG. 6 is a plan view illustrating the nozzle plate.
Figure 7:
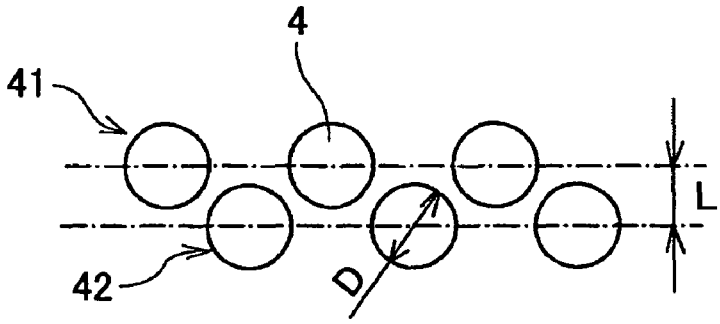
FIG. 7 is an enlarged plan view of the essential part of the nozzle plate.

Herein, the first example of the configuration of the nozzle plate 2 to simplify a coating process for forming the resin layer 32 as described above is described with reference to FIG. 6 and FIG. 7. Also, FIG. 6 is a plan view illustrating the nozzle plate and FIG. 7 is an enlarged plan view illustrating the essential part of the nozzle plate.

The nozzle plate 2 has nozzle sequences 41 and 42 in which plural nozzles 4 are aligned and the respective nozzle sequences 41 and 42 are formed such that the nozzles 4 are arranged in a zigzag pattern. Then, as the hole diameter (the diameter) of the nozzle is defined as D, the two nozzle sequences 41 and 42 are arranged at an interval L equal to or less than the nozzle hole diameter D (L≦D).

When the nozzle sequences 41 and 42 are thus arranged and a resin is applied by a dispenser, the resin can be applied on the entire surface of the nozzle substrate 31 by only coat-scanning the outside of the nozzle sequences 41 and 42 while no resin enters the inside of the nozzle hole 34 even if the application is performed on the condition that no air, etc., blows out from the nozzle hole 34.

Figure 8:
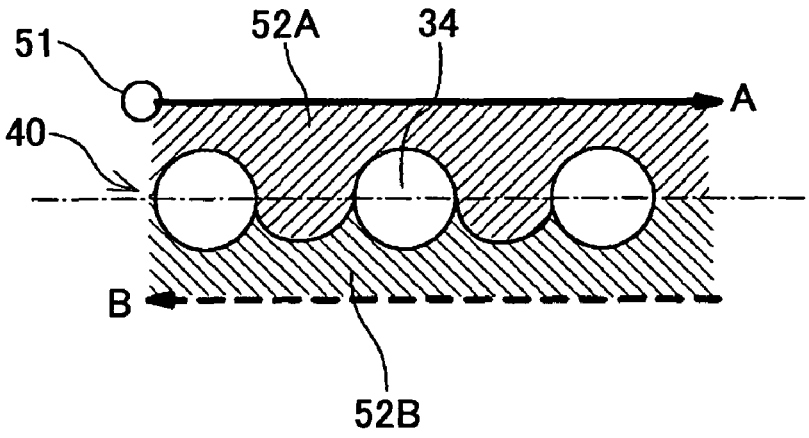
FIG. 8 is a diagram illustrating a coating application condition when a nozzle sequence is in line.

That is, when a silicone resin is applied on the surface of a nozzle plate (the surface of a nozzle substrate) by a dispenser and if the number of nozzle sequence is one as shown in FIG. 8, one outside of the nozzle sequence 40 is coat-scanned by (the ejection port of) a dispenser 51 (by moving it for application) in a direction denoted by an arrow A, whereby a resin 52 spreads to the other side away from the centerline between nozzle holes 34, and then, the other outside of the nozzle sequence 40 is coat-scanned by (the ejection port of) the dispenser 51 in a direction denoted by an arrow B, whereby a resin 52B spreads to the one side away from the centerline between the nozzle holes 34. Thus, the resin can be applied on the entire surface of the nozzle substrate 31 by the two coat-scanning operations as a whole.

In this case, the resin cannot enter the inside of the nozzle hole 34 by the spontaneous spreading of the resin, due to the surface tension of the resin.

Figure 9:
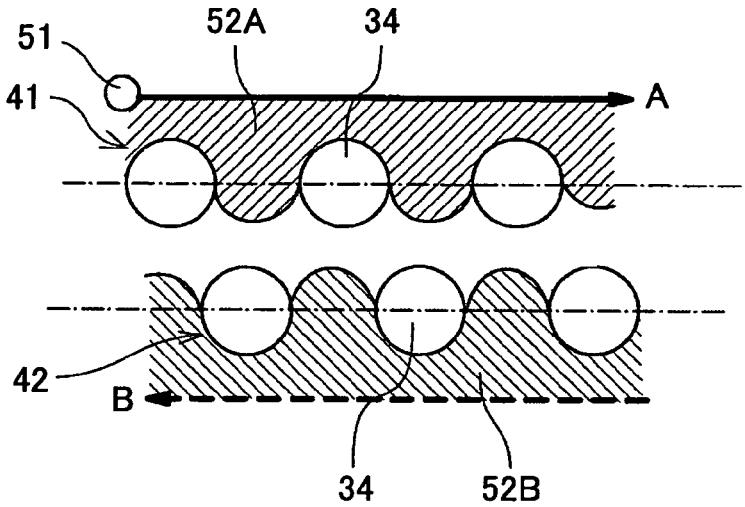
FIG. 9 is a diagram illustrating a coating application condition when the space between nozzle sequences is greater than the diameter of a nozzle hole.

However, when the number of nozzle sequence is two, for example, as the nozzle sequences 41 and 42 are arranged in a zigzag pattern, and if the interval L between the nozzle sequences 41 and 42 is greater than the diameter D of the nozzle hole 34 (if L>D) as shown in FIG. 9, the outside of the nozzle sequence 41 is coat-scanned in a direction noted by an arrow A whereby a resin 52A spreads to the side of nozzle sequence 42 away from the centerline between the nozzle holes 34 but does not spread to the nozzle hole 34 of the other nozzle sequence 42, and similarly, the outside of the nozzle sequence 42 is coat-scanned by (the ejection port of) the dispenser 51 in a direction denoted by an arrow B whereby a resin 52B spreads to the side of nozzle sequence 41 away from the centerline between the nozzle holes 34 but does not spread to the nozzle hole 34 of the one nozzle sequence 41.

Accordingly, as a result, a lack of application may occurs between the nozzle sequences 41 and 42, and there may be a possibility such that it is not only necessary to the third coat-scanning to apply the resin between the nozzle sequences 41 and 42 but also the resin enters the inside of the nozzle hole 34 at the time of application, depending on the interval between the nozzle sequences 41 and 42.

Figure 10:
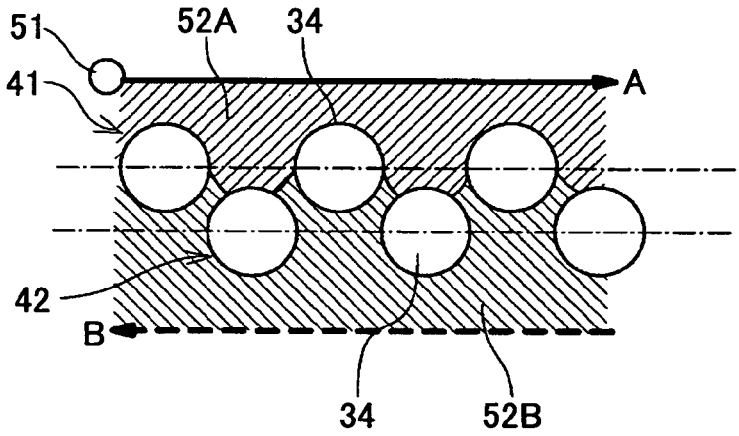
FIG. 10 is a diagram illustrating a coating application condition when the space between nozzle sequences is equal to or less than the diameter of a nozzle hole.

Herein, in the embodiment, when the number of nozzle sequence ids two, that is, as the nozzle sequences 41 and 42 are arranged in a zigzag pattern, the interval L between the nozzle sequences 41 and 42 is set to be equal to or less than the diameter D of the nozzle hole 34 ($L \leqq D$) as shown in FIG. 10. Accordingly, as the outside of the nozzle sequence 41 is coat-scanned in a direction denoted by an arrow A whereby a resin 52 A spreads to the side of nozzle sequence 42 across the centerline between the nozzle holes 34 and between the nozzle holes 34 of the nozzle sequence 41 and the nozzle holes 34 of the nozzle sequence 42, and similarly, the outside of the nozzle sequence 42 is coat-scanned by (the ejection port of) the dispenser 51 in a direction denoted by an arrow B whereby a resin 52B spreads to the side of nozzle sequence 41 across the centerline between the nozzle holed 34 and between the nozzle holes 34 of the nozzle sequence 42 and the nozzle holes 34 of the nozzle sequence 41. Thus, the resin is also applied between the nozzle sequences 41 and 42.

Therefore, the resin can be applied on the surface of the nozzle plate by the two coat-scanning operations, so that the coating process can be simplified. Additionally, the respective outsides of the nozzle sequences 41 and 42 can be approximately simultaneously applied by plural dispensers (in this case, merely, substantially plural coat-scanning operations are simultaneously performed.).

Figure 11:
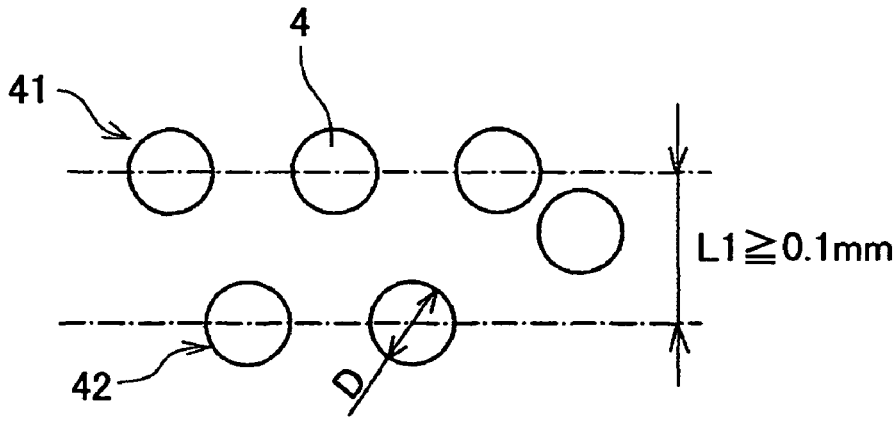
FIG. 11 is an enlarged plan view of the essential part of a nozzle plate for the illustration of another embodiment of the present invention.

Next, the second example of the configuration of the nozzle plate 2 to simplify a coating process for forming the resin layer 32 is described with reference to FIG. 11. Additionally, FIG. 11 is an enlarged plan view illustrating the essential part of the nozzle plate.

Herein, the nozzle plate 2 also has nozzle sequences 41 and 42 in which plural nozzles 4 are aligned, and the respective nozzle sequences 41 and 42 are formed such that the nozzles 4 are arranged in a zigzag pattern. Then, the two nozzle sequences 41 and 42 are arranged at an interval L1 equal to or greater than 0.1 mm (100 μm).

When the nozzle sequences 41 and 41 are thus arranged and a resin is applied by a dispenser, the outsides of the nozzle sequences 41 and 42 are coat-scanned and the space between the nozzle sequences 41 and 42 is also coat-scanned, the resin can be applied on the entire surface of the nozzle substrate 31 while no resin enter the inside of the nozzle hole 34 even if the application is performed on the condition that no air, etc., blows out from the nozzle hole 34.

That is, as previously illustrated in FIG. 9, when the interval L between the nozzle sequences 41 and 42 is greater than the diameter D of the nozzle hole 34 (when $L>D$), the resin cannot be applied between the nozzle sequences 41 and 42 by only coat-scanning the respective outsides of the nozzle sequences 41 and 42. Therefore, the resin is applied between the nozzle sequences 41 and 42 by coat-scanning the space between the nozzle sequences 41 and 42, but when the space between the nozzle sequences 41 and 42 is small (particularly, when it is smaller than the application width of a dispenser for applying the resin), the resin enters the inside of the nozzle hole 34 at the time of coat-scanning between the nozzle sequences 41 and 42. Therefore, it is set to be greater than the application width of a dispenser for applying the resin between the nozzle sequences 41 and 42, particularly equal to or greater than 100 μm, whereby the resin can be applied by coat-scanning the space between the nozzle sequences 41 and 42 while no resin enters the inside of the nozzle hole 34.

Additionally, this can be similarly applied to a nozzle forming member or liquid ejecting head in which plural nozzle sequences are not arranged in a zigzag pattern.

Figure 12:
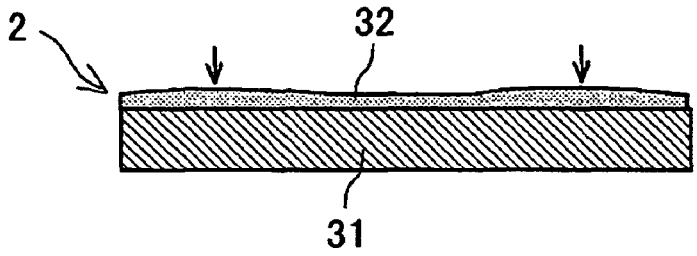
FIG. 12 is a diagram illustrating that the film thickness of a resin layer is partially increased when plural coat-scanning are conducted by a coating device.

As described above, when the resin film 32 is formed by performing plural coat-scanning operations for the nozzle substrate 31, the film thickness of the resin film 32 on a part (the part being denoted by an arrow) scanned by a coating device (for example, a dispenser) tends to be relatively greater than that on the other part, as shown in FIG. 12, which, however, causes no practical problem.

Next, one example of a method of manufacturing a liquid ejecting head according to the present invention is described with reference to FIG. 13.

Figure 13:
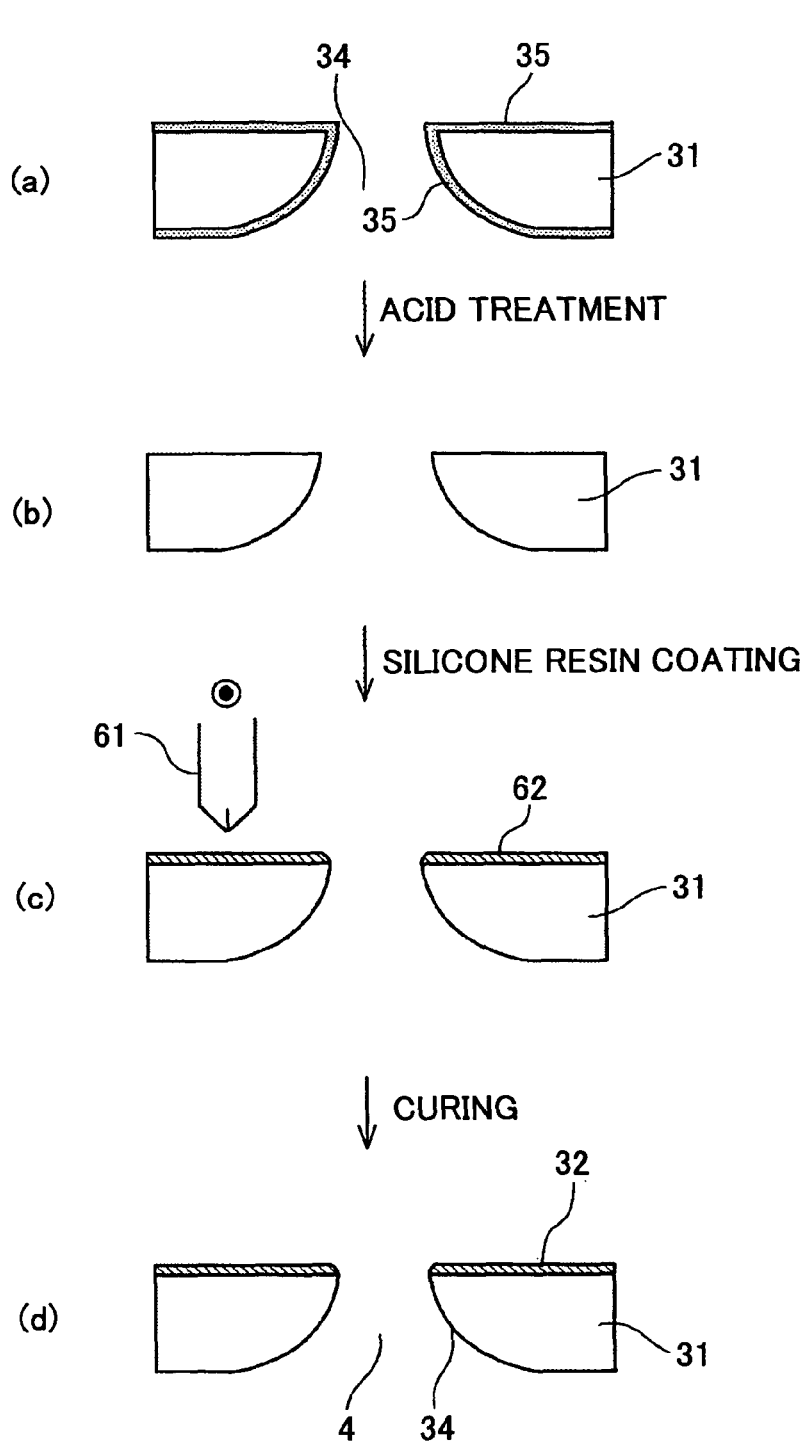
FIG. 13 is a cross-sectional diagram illustrating one example of a method of manufacturing a liquid ejecting head according to the present invention.

First, as shown in FIG. 13(*a*), since an oxide film 35 as a spontaneously oxidized film or a liquid contacting film is formed on the surface of a nozzle substrate 31 formed by means of Ni-electroforming, acid treatment is performed so as to remove the oxide film 35 on the surface and the surface is subjected to hydroxyl group substitution with a as shown in FIG. 13(*b*), subsequently, a liquid silicone resin is applied on the nozzle substrate 31 by a dispenser 61 so as to form a silicone resin coating 62 as shown in FIG. 13(*c*), and the silicone resin coating 62 is cured so as to form a resin layer 32 is formed as a water-repellent layer as shown in FIG. 13(*d*).

Thus, the acid treatment is performed to remove the oxide film, whereby the resin layer 32 can be formed by applying a silicone resin in the atmosphere on the condition of no oxide film on the surface of the nozzle substrate 31 at the side of ejection face. In this case, a spontaneously oxidized film may be produced on the surface of the nozzle substrate 31 by means of exposure to the atmosphere from the acid treatment to the application of a silicone resin, and a sufficient adhesive strength of the silicone resin and the nozzle substrate is obtained with respect to a thin spontaneously oxidized film.

Additionally, the oxide film removal treatment may be conducted by, for example, plasma treatment or ultraviolet-ray irradiation treatment, and the acid treatment is the simplest one and can be conducted with a low cost.

Figure 14:
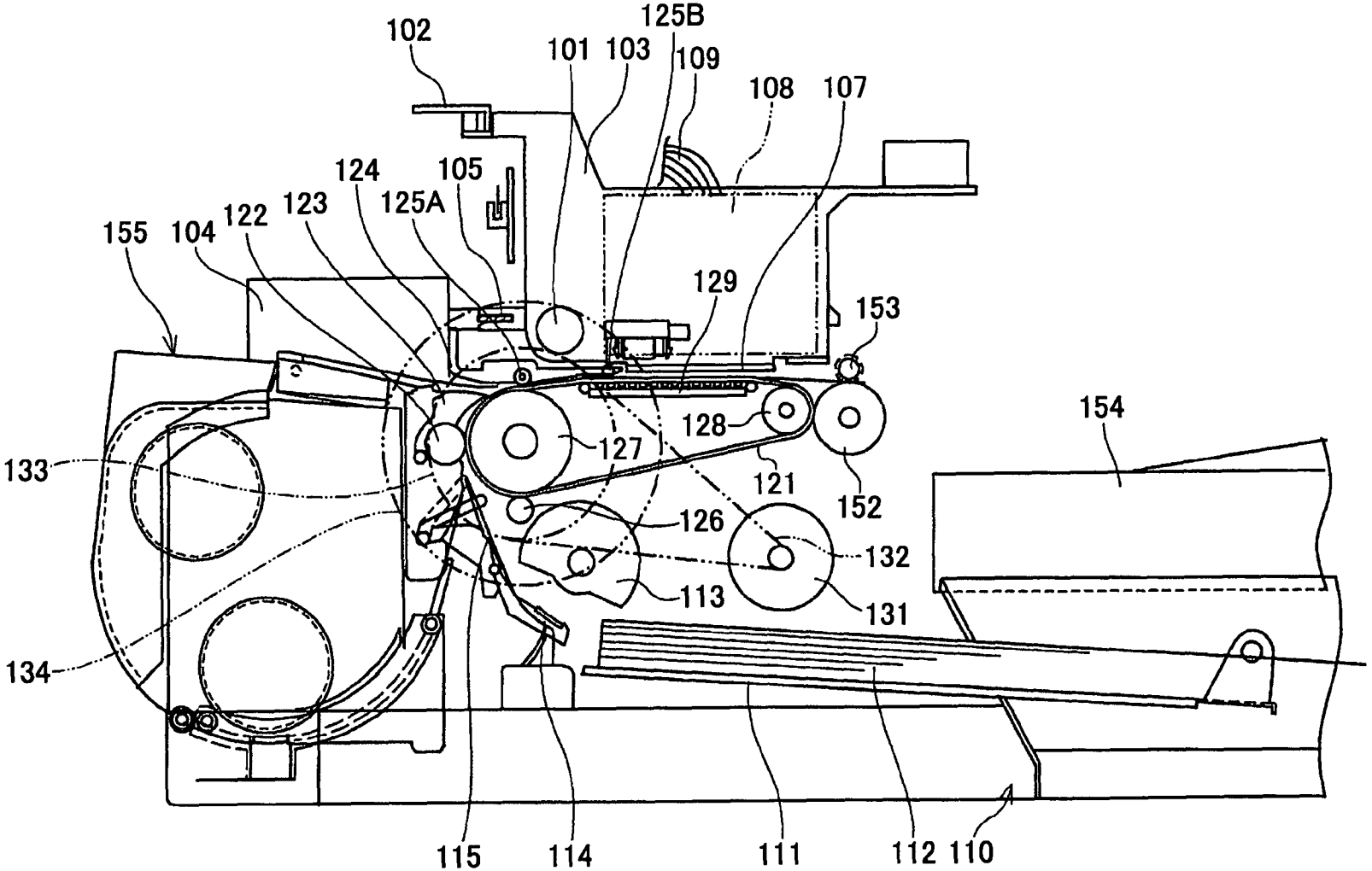
FIG. 14 is a general-structural diagram showing one example of an image forming apparatus according to the present invention.
Figure 15:
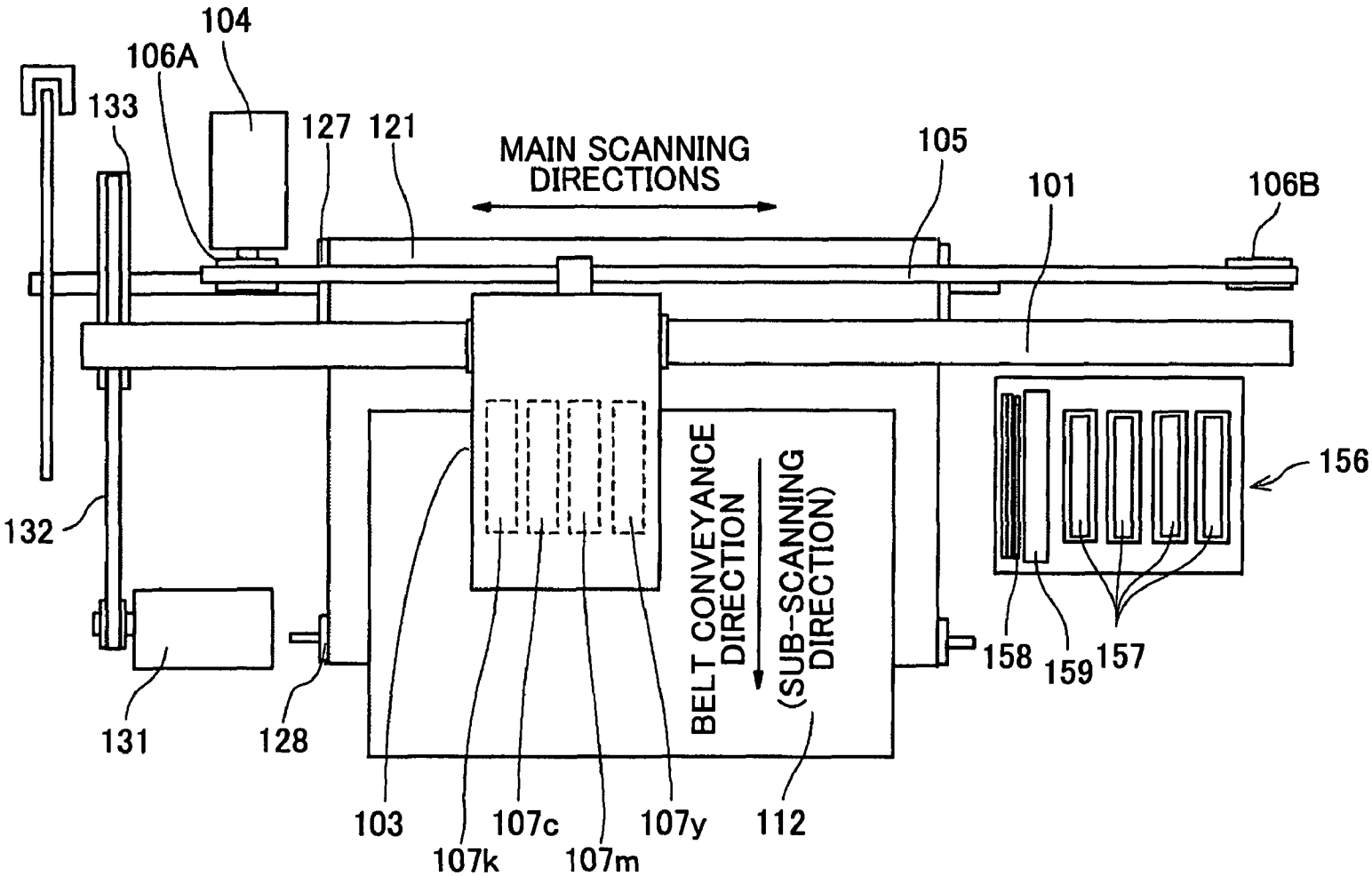
FIG. 15 is a plan view illustrating the essential part thereof.

Next, one example of an image forming apparatus including a liquid drop ejecting device according to the present invention which is provided with a liquid ejecting head according to the present invention is described with reference to FIGS. 14 and 15. Herein, FIG. 14 is a side view illustrating the entire structure of the image forming apparatus and FIG. 15 is a plan view illustrating the essential part of the apparatus.

The image forming apparatus includes a guide rod 101 and a guide rail 102 which are guide members extending between and supported by the right and left side plates which are not shown in the figures and slidably hold a carriage 103 in the main scanning directions, which carriage is moved for scanning in the directions of arrows (the main scanning directions) using a timing belt 105 extending over a driving pulley 106A and a passive pulley 106B which are driven by a main scanning motor 104.

On the carriage 103, a recording head 107 composed of four independent liquid ejecting heads 107*k*, 107*c*, 107*m* and

107*y* according to the present invention which eject a liquid drop (ink drop) of recording liquid of each color (such as black (K), cyan (C), magenta (M) and yellow(Y)) is arranged in directions along the main scanning direction and provided such that the liquid drop ejecting direction is set downward. Additionally, although the independent liquid ejecting head is used herein, one or plural heads having plural nozzles for ejecting a liquid drop of recording liquid of each color may be also used. Also, the number and arrangement order of colors are not limited to them.

A sub-tank 108 of each color for supplying ink of each color to the recording head 107 is mounted on the carriage 103. Ink is fed and supplied from a main tank (ink cartridge) which is not shown in the figures through an ink supply tube 109 to the sub-tank 108.

Furthermore, a paper feeding part for feeding a medium to be recorded (paper sheet) stacked on a paper stacking part (pressing plate) 111 such as a paper feeding cassette 110 includes a separating pad 114 facing a crescent control roller (paper feeding roller) 113 and made of a material with a high friction coefficient which is provided for separating and feeding paper sheets 112 one by one from the paper stacking plate 111, and the separating pad 114 is pushed to the side of the paper feeding roller 113.

Then, as a conveying part for conveying the paper sheet 112 fed from the paper feeding part under the recording head 107, there is included a conveyor belt 121 for electrostatically attracts and conveying the paper sheet 112, a counter roller 122 for pressing the paper sheet 112 fed from the paper feeding part via a guide 115 against the conveyor belt 121 and conveying it, a conveying guide 123 for changing the moving direction of the paper sheet 112 fed approximately vertically and upward by approximately 90° so that it is laid on the conveyor belt 121, a pressing roller 125A and a leading edge pressing roller 125B which are pushed to the side of the conveyor belt 121 by a pressing member 124. Also, a charging roller 126 as a charging device for charging the surface of the conveyor belt 121 is included.

Herein, the conveyor belt 121 is an endless belt, extends over a conveying roller 127 and a tension roller 128, and rotates to a belt rotation direction (a sub-scanning direction) by rotating the conveying roller 127 using a timing belt 132 and a timing roller 133 which are driven by a sub-scanning motor 131. Additionally, a guide member 129 is arranged in a location corresponding to an image forming area of the recording head 107 at the back side of the conveyor belt 121.

The charging roller 126 is located so as to contact the front surface of the conveyor belt 121 and to passively rotate by the rotation of the conveyor belt 121 and applies a pressure of 2.5 N to each end of a shaft.

Further, as a paper ejecting part for ejecting the paper sheet 112 on which an image has been recorded by the recording head 107, there are included a sheet separating part for separating the paper sheet 112 from the conveyor belt 121, a paper ejecting roller 152, another paper ejecting roller 153, and an ejected paper tray 154 for stocking the ejected paper sheet 112.

Also, a double-face paper feeding unit 155 is detachably attached to the back portion thereof. The double-face paper feeding unit 155 receives and reverses the paper sheet 112 which is conveyed backward by the conveyor belt 121 rotating in the opposite direction, and feeds it again into the space between the counter roller 122 and the conveyor belt 121.

Further, as shown in FIG. 14, a maintenance and refreshing mechanism 156 for maintaining or refreshing the state of a nozzle of the recording head 107 is arranged in a non-printing area at the side of one of the scanning directions of the carriage 103.

The maintenance and refreshing mechanism 156 includes caps 157 for capping respective nozzle faces of the recording head 107, a wiper blade 158 which is a blade member for wiping the nozzle face, and a blank-ejection receiver 159 for receiving a liquid drop when blank ejection is performed ejecting in which the liquid drop does not contribute to recording and is ejected to eliminate thickened recording liquid.

Next, an ink as recording liquid used in a recording method according to the present invention is described in which method a liquid drop is ejected from a liquid ejecting head according to the present invention to conduct recording on a recording medium (paper sheet).

An ink used in the recording method according to the present invention contains, at least, water, a coloring agent and a wetting agent, and further a penetrating agent, a surfactant and another component according to need.

Herein, the surface tension of the ink at 25° C. is 15-40 mN/m, and preferably 20-35 mN/m. If the surface tension is less than 15 mN/m, a nozzle plate (nozzle board) of the liquid ejecting head according to the present invention is wetted excessively so that it may be difficult to form an ink drop (particle), bleeding on a recording medium used in the recording method according to the present invention may become significant, and it may be difficult to attain stable ejection of ink. On the other hand, if it is greater than 40 mN/m, the no sufficient penetration of ink into a recording medium may be caused and the occurrence of beading or a prolonged drying time may be caused.

The surface tension can be measured at 25° C. by using, for example, a surface tensiometer (CBVP-Z available from Kyowa Interface Science Co., Ltd.) and a platinum plate.

Also, as a coloring material of ink, either a pigment or a dye can be used and a mixture thereof can be used. Additionally, when a pigment is used, it is relatively easy to form a high quality image with excellent weatherability and water resistance on a normal paper sheet, compared to a dye.

[Pigments]

As a pigment, the following ones can be preferable used. Also, a mixture of plural kinds of the pigments may be used.

As an organic pigment, there can be provided, for example, azoic, phthalocyanine-based, anthraquinone-based, quinacridone-based, dioxazine-based, indigo-based, thioindigo-based, perylene-based, and isoindolinone-based pigments, aniline black, azomethine-type pigments, rhodamine B lake pigment, and carbon black.

As an inorganic pigment, there can be provided, for example, iron oxide, titanium oxide, calcium carbonate, barium sulfate, aluminum hydroxide, barium yellow, iron blue, cadmium red, chrome yellow, and metal powder.

The particle diameter of the pigment is preferably 0.01-0.30 μm, and if it is 0.01 μm or less, the light fastness thereof may be degraded or feathering may be easily caused since the particle diameter is close to that of dye. On the other hand, if it is 0.30 μm or greater, clogging of an ejection port or a filter in a printer may be caused and stable ejection may be hardly attained. 0.01-0.16 μm is more preferable from the viewpoint of the clogging or the stable ejection.

As a carbon black used for a black pigment ink, preferable is a carbon black manufactured by a furnace method or a channel method and having a primary diameter of 15-40 millimicrons, a BET specific surface area of 50-300 square meter/g, a DBP oil absorption of 40-150 ml/100 g, 0.5-10% of a volatile component, and a pH value of 2-9. As such, there can be used, for example, No. 2300, No. 900, MCF-88, No. 33, No. 40, No. 45, No. 52, MA7, MA8, MA100, No. 2200B (which are available from Mitsubishi Chemical Corporation), Raven 700, Raven 5750, Raven 5250, Raven 5000, Raven 3500, Raven 1255 (which are available from Columbian Chemicals Company), Regal 400R, Regal 330R, Regal 660R, MogulL, Monarch 700, Monarch 800, Monarch 880, Monarch 900, Monarch 1000, Monarch 1100, Monarch 1300, Monarch 1400 (which are available from Cabot Corporation), Color black FW1, Color black FW2, Color black FW2V, Color black FW18, Color black FW200, Color black S150, Color black S160, Color black S170, Printex 35, Printex U, Printex V, Printex 140U, Printex 140V, Special black 6, Special black 5, Special black 4A, and Special black 4 (which are available from Degussa), but it is not limited to them.

Specific examples of color pigments are provided below.

As an organic pigment, there can be provided, for example, azoic, phthalocyanine-based, anthraquinone-based, quinacridone-based, dioxazine-based, indigo-based, thioindigo-based, perylene-based, and isoindolinone-based pigments, aniline black, azomethine-type pigments, rhodamine B lake pigment, and carbon black, and as an inorganic pigment, there can be provided, for example, iron oxide, titanium oxide, calcium carbonate, barium sulfate, aluminum hydroxide, barium yellow, iron blue, cadmium red, chrome yellow, and metal powder.

Specifically, the following ones for each color are provided below.

As an example of a pigment which can be used for yellow ink, there can be provided, for example, CI pigment yellows 1, 2, 3, 12, 13, 14, 16, 17, 73, 74, 75, 83, 93, 95, 97, 98, 114, 128, 129, 151, and 154, but it is not limited to them.

As an example of a pigment which can be used for magenta ink, there can be provided, for example, CI pigment reds 5, 7, 12, 48 (Ca), 48 (Mn), 57 (Ca), 57:1, 112, 123, 168, 184, and 202, but it is not limited to them.

As an example of a pigment which can be used for cyan ink, there can be provided, for example, CI pigment blues 1, 2, 3, 15:3, 15:34, 16, 22, and 60, and CI vat blue 4 and 60, but it is not limited to them.

Also, a pigment which is newly manufactured for the present invention can be used as a pigment contained in each ink used in the present invention.

An ink jet recording liquid may be obtained by dispersing the pigment described above in an aqueous medium using a polymeric dispersing agent or a surfactant. As a dispersing agent for dispersing powder of such an organic pigment, a commonly used water-soluble resin or water-soluble surfactant can be used.

As a specific example of the water-soluble resin, there can be provided, for example, block copolymers, random copolymers, and salts thereof, which copolymers are obtained from at least two kinds of monomers selected from the group including styrene, styrene derivatives, vinylnaphthalene derivatives, aliphatic alcohol esters of $\alpha,\beta$-ethylene unsaturated carboxylic acids, acrylic acid, acrylic acid derivatives, maleic acid, maleic acid derivatives, itaconic acid, itaconic acid derivatives, fumarate, and fumarate derivatives.

These water-soluble resins are alkali-soluble resins which are soluble in aqueous solution in which a base is dissolved, and among these, it is particularly preferable that the weight-average molecular weight thereof is 3,000-20,000, since an advantage can be obtained such that the viscosity of a dispersion liquid can be reduced and the dispersion is easily attained, in the case of use in an ink jet recording liquid.

Also, a combination of a polymeric dispersing agent and a self-dispersing pigment is preferable to obtain an appropriate dot diameter. The reason has not been necessarily clear but can be considered as follows.

The penetration into a recording paper sheet is suppressed by containing a polymeric dispersing agent. On the other hand, since aggregation of a self-dispersing pigment is suppressed by containing a polymeric dispersing agent, the self-dispersing pigment can spread smoothly in the horizontal directions. As a result, a dot spreads widely and thinly so that a desirable dot can be formed.

Also, as a specific example of a water-soluble surfactant which can be used as a dispersing agent, the following ones can be provided. For example, as an anionic surfactant, there can be provided, for example, higher fatty acid salts, alkyl sulfates, alkyl ether sulfates, alkyl ester sulfates, alkyl aryl ether sulfates, alkyl sulfonates, sulfosuccinates, alkyl allyl sulfonates, alkyl naphthalene sulfonates, alkyl phosphate, polyoxyethylene alkyl ether phosphates, and alkyl allyl ether phosphates. Also, as a cationic surfactant, there can be provided, for example, alkyl amine salts, dialkyl amine salts, tetraalkyl ammonium salts, benzalkonium salts, alkyl pyridinium salts, and imidazolinium salts.

Further, as an amphoteric surfactant, there can be provided, for example, dimethyl alkyl lauryl betaines, alkyl glycines, alkyl di(aminoethyl) glycines, and imidazolinium betaines. As a nonionic surfactant, there can be provided, for example, polyoxyethylene alkyl ethers, polyoxyethylene alkyl allyl ethers, polyoxyethylene polyoxypropylene glycol, glycerin esters, sorbitan esters, sucrose esters, polyoxyethylene ethers of glycerin esters, polyoxyethylene ethers of sorbitan esters, polyoxyethylene ethers of sorbitol esters, fatty acid alkanolamides, polyoxyethylene fatty acid amides, amine oxides, and polyoxyethylene alkylamines.

Also, the pigment can be coated with or microencapsulated by a resin having a hydrophilic group so as to provide it with dispersibility.

As a method for coating a water-insoluble pigment with or microencapsulating it by an organic polymer, any of the publicly known methods can be used. As a publicly known method, there can be provided, for example, chemically manufacturing methods, physically manufacturing methods, physically chemical methods, and mechanically manufacturing methods. Specifically, there can be provided, for example, an interfacial polymerization method, an in-situ polymerization method, a submerged cured coating method, a coacervation (phase separation) method, a submerged drying method, a melting-dispersion-cooling method, an aerial suspension coating method, a spray-drying method, an acid precipitation method, and a phase inversion emulsification method.

The interfacial polymerization method is a method such that two kinds of monomers or two kinds of reactants are separately dissolved in a dispersion phase and a continuous phase and both substances are reacted on the interface therebetween so as to form a wall film. The in-situ polymerization method is a method such that a liquid or gaseous monomer and a catalyst or two kinds of reactive substances are provided from either of the sides of a continuous phase and nuclear particles so as to cause reaction and to form a wall film. The submerged cured coating method is a method such that drops of a polymer solution containing particles of a core material is insolubilized by a curing agent, etc., in liquid so as to form a wall film.

The coacervation (phase separation) method is a method such that a polymer dispersion liquid in which particles of a core material are dispersed is separated into a coacervate (concentrated phase) with a high polymer concentration and a diluted phase so as to form a wall film. The submerged drying method is a method such that a liquid in which a core material is dispersed in a solution of a wall film material is prepared, the dispersion liquid is added into a liquid which is not miscible with a continuous phase of the dispersion liquid so as to obtain a complex emulsion, and a medium dissolving the water film material is gradually removed so as to form a wall film.

The melting-dispersion-cooling method is a method such that a wall film material which is melted into liquid by heating and solidified at ordinary temperature is heated and liquefied, particles of a core material are dispersed therein, they are made be fine particles, and cooling is performed to form a wall film. The aerial suspension coating method is a method such that particles of a core material are suspended as powder in gas by a fluidized bed and floated in gas stream while a coating liquid of a wall film material is sprayed and mixed therein so as to form a wall film.

The spray-drying method is a method such that a stock solution for capsulation is sprayed and contacted with hot wind so as to evaporate and dry a volatile component whereby a wall film is formed. The acid precipitation method is a method such that at least one of anionic groups of an organic polymeric compound containing the anionic groups is neutralized with a basic compound so as to provide the solubility to water, kneading is made with a coloring material in an aqueous medium, subsequently, neutralization or acidification is made with an acidic compound so as to precipitate organic compounds and fix them on the coloring material, and finally, neutralization and dispersion are made. The phase inversion emulsification method is a method such that while a mixture containing an anionic organic polymer having dispersibility in water and a coloring material is provided as a organic solvent phase, water is thrown into the organic solvent phase or the organic solvent phase is thrown into water.

As an organic polymer (resin) used for a material for constituting a wall film of a microcapsule, there can be provided, for example, polyamides, polyurethanes, polyesters, polyureas, epoxy resins, polycarbonates, urea resins, melamine resins, phenol resins, polysaccharides, gelatin, gum Arabic, dextran, casein, proteins, natural rubbers, carboxypolymethylene, polyvinyl alcohol, polyvinyl pyrrolidone, polyvinyl acetate, polyvinyl chloride, polyvinylidene chloride, cellulose, ethylcellulose, methylcellulose, nitrocellulose, hydroxyethylcellulose, cellulose acetate, polyethylene, polystyrene, homopolymers and copolymers of (meth)acrylic acid, homopolymers and copolymers of (meth)acrylates, (meth)acrylic acid-(meth)acrylate copolymer, styrene-(meth)acrylic acid copolymer, styrene-maleic acid copolymer, sodium alginate, fatty acids, paraffins, beeswax, water wax, hardened beef tallow, carnauba wax, and albumin.

Among these, organic polymers having an anionic group such as a carboxyl group or a sulfone group can be used. Also, as a nonionic organic polymer, there can be provided, for example, polyvinyl alcohol, polyethylene glycol monomethacrylate, polypropylene glycol monomethacrylate, methoxypolyethylene glycol monomethacrylate and copolymers thereof, and cationic ring-opening polymers of 2-oxazoline. Particularly, polyvinyl alcohol obtained through complete saponification has a low water-solubility and a property such that it is easily dissolved in hot water but is not easily dissolved in cold water, which is particularly preferable.

Also, the content of an organic polymer for constituting a wall film of a microcapsule is 1% by weight or more and 20% by weight or less of a water-insoluble coloring material such as organic pigments and carbon blacks. As the content of the organic polymer is in the range described above, the content of the organic polymer in the capsule is comparatively low and, therefore, the lowering of the coloring property of a pigment which is caused by coating the surface of the pigment with the organic polymer can be suppressed. If the content of the organic polymer is less than 1% by weight, it may be difficult to provide the effect of capsulation, and, on the other hand, if it is more than 20% by weight, the coloring property of the pigment may be significantly lowered. Further, as other properties thereof are taken into consideration, the content of the organic polymer is preferably in a range of 5-10% by weight of the water-insoluble coloring material.

That is, since a part of the coloring material is not coated but is substantially exposed, the lowering of the coloring property can be suppressed and, on the other hand, a part of the coloring material is not exposed but is substantially coated, the effect of coating the pigment is simultaneously provided. Also, the number-average molecular weight of the organic polymer is preferably 2,000 or greater from the viewpoint of the manufacture of a capsule. Herein, "being substantially exposed" does not mean a partial exposure associated with a defect such as a pinhole and a crack but means the condition of being positively exposed.

Further, when an organic pigment which is a self-dispersive pigment or a self-dispersive carbon black is used as a coloring material, even if the content of the organic polymer in the capsule is comparatively low, the dispersibility of the pigment can be improved and, therefore, a sufficient storage stability can be obtained, which is more preferable for the present invention.

Additionally, it is preferable to select a suitable organic polymer depending on a method of microencapsulation. For example, for an interfacial polymerization method, polyesters, polyamides, polyurethanes, polyvinyl pyrrolidone, epoxy resins, etc., are suitable. For an in-situ polymerization method, homopolymers and copolymers of (meth)acrylates, (meth)acrylic acid-(meth)acrylate copolymers, styrene-(meth)acrylic acid copolymers, polyvinyl chloride, polyvinylidene chloride, polyamides, etc., are suitable. For a submerged cured coating method, sodium alginate, polyvinyl alcohol, gelatin, albumin, epoxy resins, etc., are preferable. For a coacervation method, gelatin, celluloses, casein, etc., are suitable. Of course, any of the publicly known encapsulation methods in addition to those described above can be also utilized for obtaining a fine and uniform microencapsulated pigment.

When a phase inversion method or an acid precipitation method is selected as a method of microcapsulation, an anionic organic polymer is used as an organic polymer for providing a wall film of a microcapsule. The phase inversion method is a method such that a complex of an anionic organic polymer having self-dispersibility or solubility in water and a coloring material such as a self-dispersive organic pigment or a self-dispersion-type carbon black or a mixture of the anionic organic polymer, a coloring material such as a self-dispersive organic pigment or a self-dispersion-type carbon black, and a curing agent is provided as an organic solvent phase and microcapsulation is conducted while self-dispersion (phase inversion emulsification) is caused by throwing water into the organic solvent phase or throwing the organic solvent phase into water. In the inversion phase method, it is not problematic to mix a vehicle for recording liquid or an additive into the organic solvent phase for the manufacture. Particularly, it is more preferable to mix a liquid medium for recording liquid since a dispersion liquid for recording liquid can be directly manufactured.

On the other hand, the acid precipitation method is a method such that a part of or all anionic groups in a water-containing cake obtained by a manufacturing method including a processes of neutralizing a part of or all anionic groups of an organic polymer containing the anionic groups with a basic compound, kneading it with a coloring material such as a self-dispersive organic pigment or a self-dispersion-type carbon black in aqueous medium, and to control the pH to neutral or acidic using an acidic compound to precipitate and fix the anionic group-containing organic polymer on the pigment, is neutralized using a basic compound, thereby conducting the microencapsulation. Thus, an aqueous dispersion liquid containing a fine anionic microencapsulated pigment containing much pigment can be manufactured.

Also, as a solvent used in the microencapsulation as described above, there can be provided, for example, alkylalcohols such as methanol, ethanol, propanol and butanol; aromatic hydrocarbons such as benzole, toluole and xylole; esters such as methyl acetate, ethyl acetate and butyl acetate; chlorinated hydrocarbons such as chloroform and ethylene dichloride; ketones such as acetone and isobutyl methyl ketone; ethers such as tetrahydrofuran and dioxane; and cellosolves such as methylcellosolve and butylcellosolve. Also, the microcapsules prepared by the method described above is once separated from the solvent by means of centrifugal separation, filtration, or the like and stirred and re-dispersed in water and necessary solvent so as to an objective recording liquid which can be used for the present invention. The average particle diameter of the encapsulated pigment obtained by a method as described above is preferably 50 nm-180 nm.

Thus, the pigment adheres to an object to be printed due to such a resin coating so that the rubbing resistance of the object to be printed can be improved.

[Dyes]

As a dye used for recording liquid, dyes classified in acidic dyes, direct dyes, basic dyes, reactive dyes and food colors in color indices and having excellent water resistance and light fastness are used. Plural kinds of these dyes may be mixed and used or, if necessary, may be mixed and used with another color material such as a pigment. Such a coloring agent is added in a range such that the effect of the present invention is not inhibited.

(a) As acidic dyes and food colors, for example,

C.I. acid yellows 17, 23, 42, 44, 79, and 142,

C.I. acid reds 1, 8, 13, 14, 18, 26, 27, 35, 37, 42, 52, 82, 87, 89, 92, 97, 106, 111, 114, 115, 134, 186, 249, 254, and 289, C.I. acid blues 9, 29, 45, 92, and 249, C.I. acid blacks 1, 2, 7, 24, 26, and 94, C.I. food yellows 3 and 4, C.I. food reds 7, 9, and 14, and C.I. food blacks 1 and 2, can be used.

(b) As direct dyes, for example,

C.I. direct yellows 1, 12, 24, 26, 33, 44, 50, 86, 120, 132, 142, and 144,

C.I. direct reds 1, 4, 9, 13, 17, 20, 28, 31, 39, 80, 81, 83, 89, 225, and 227,

C.I. direct oranges 26, 29, 62, and 102,

C.I. direct blues 1, 2, 6, 15, 22, 25, 71, 76, 79, 86, 87, 90, 98, 163, 165, 199, and 202, and C.I. direct blacks 19, 22, 32, 38, 51, 56, 71, 74, 75, 77, 154, 168, and 171, can be used.

(C) As basic dyes, for example,

C.I. basic yellows 1, 2, 11, 13, 14, 15, 19, 21, 23, 24, 25, 28, 29, 32, 36, 40, 41, 45, 49, 51, 53, 63, 64, 65, 67, 70, 73, 77, 87, and 91, C.I. basic reds 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, and 112, C.I. basic blues 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, and 155, and C.I. basic blacks 2 and 8, can be used.

(d) As reactive dyes, for example,

C.I. reactive blacks 3, 4, 7, 11, 12, and 17,

C.I. reactive yellows 1, 5, 11, 13, 14, 20, 21, 22, 25, 40, 47, 51, 55, 65, and 67, C.I. reactive reds 1, 14, 17, 25, 26, 32, 37, 44, 46, 55, 60, 66, 74, 79, 96, and 97, and C.I. reactive blues 1, 2, 7, 14, 15, 23, 32, 35, 38, 41, 63, 80, and 95, can be used.

[Additives and Physical Properties Common to Pigments and Dyes]

It is preferable to use a water-soluble organic solvent as well as a coloring material for the purposes of providing recording liquid used for an image forming apparatus according to the present invention with a desired physical property or preventing clogging in a nozzle of a recording head which is caused by the drying of the recording liquid. The water-soluble organic solvent may include a wetting agent or a penetrating agent. The wetting agent is added for the purpose of preventing clogging in a nozzle of a recording head which is caused by the drying of the recording liquid.

Specific examples of the wetting agents are polyhydric alcohols such as ethylene glycol, diethylene glycol, triethylene glycol, tetraethylene glycol, polyethylene glycol, propylene glycol, 1,3-butanediol, 1,3-propanediol, 2-methyl-1,3-propanediol, 1,4-butanediol, 1,5-pentanediol, 1,6-hexanediol, glycerin, 1,2,6-hexanetriol, 2-ethyl-1,3-hexanediol, 1,2,4-butanetriol, 1,2,3-butanetriol, and petriols; polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether, and propylene glycol monoethyl ether; polyhydric alcohol aryl ethers such as ethylene glycol monophenyl ether and ethylene glycol monobenzyl ether; nitrogen-containing heterocyclic compounds such as N-methyl-2-pyrrolidone, N-hydroxyethyl-2-pyrrolidone, 2-pyrrolidone, 1,3-dimethylimidazolidinone, and ϵ-caprolactam; amides such as formamide, N-methylformamide, and N,N-dimethylformamide; amines such as monoethanolamine, diethanolamine, triethanolamine, monoethylamine, diethylamine, and triethylamine; sulfur-containing compounds such as dimetyl sulfoxide, sulfolane, and thiodiethanol; propylene carbonate, ethylene carbonate, and γ-butyrolactone. These solvents are used singularly or in combination with water.

Also, the penetrating agent is added for the purpose of improving the wettability of a material to be recorded with recording liquid and adjusting the penetration speed thereof. As a penetrating agent, penetrating agents represented by the following formulas (I)-(IV) are preferable. That is, since a polyoxyethylene alkylphenyl ether-type surfactant of the following formula (I), a acetylene glycol-type surfactant of the following formula (II), a polyoxyethylene alkyl ether-type surfactant of the following formula (III) and polyoxyethylene polyoxypropylene alkyl ether-type surfactant of the following formula (IV) can lower the surface tension of liquid, the wettability can be improved and the penetration speed can be increased.

(I)

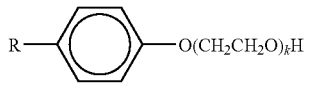

(R is a hydrocarbon chain with 6-14 carbon atoms which may be branched and k is 5-20.)

(II)

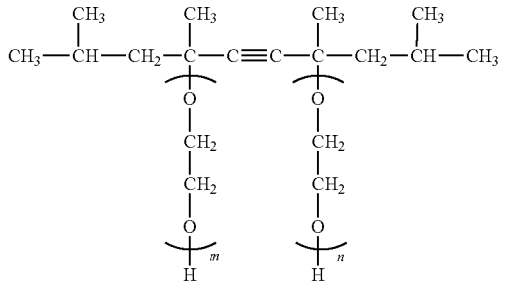

(Each of m and n is 0-40.)

$$R—(OCH_2CH_2)_nH \quad (III)$$

(R is a hydrocarbon chain with 6-14 carbon atoms which may be branched and k is 5-20.)

(IV)

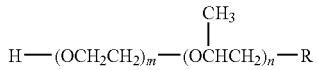

(R is a hydrocarbon chain with 6-14 carbon atoms and each of m and n is a number equal to or less than 20.)

In addition to the compounds of the formulas (I)-(IV), there can be used, for example, polyhydric alcohol alkyl or aryl ethers such as diethylene glycol monophenyl ether, ethylene glycol monophenyl ether, ethylene glycol monoallyl ether, diethylene glycol monobutyl ether, propylene glycol monobutyl ether, and tetraethylene glycol chlorophenyl ether; nonionic surfactants such as a polyoxyethylene polyoxypropylene block copolymer, fluorine-containing surfactants, and lower alcohols such as ethanol and 2-propanol, and diethylene glycol monobutyl ether is particularly preferable.

However, the surfactant is not particularly limited and can be appropriately selected depending on the purpose, and, for example, there can be provided anionic surfactants, nonionic surfactants, amphoteric surfactants, and fluorinated surfactants.

As an anionic surfactant, there can be provided, for example, polyoxyethylene alkyl ether acetates, dodecylbenzenesulfonates, laurylates, and polyoxyethylene alkyl ether sulfates.

As a nonionic surfactant, there can be provided, for example, acetylene glycol-type surfactants, polyoxyethylene alkyl ethers, polyoxyethylene alkylphenyl ethers, polyoxyethylene alkyl esters, and polyoxyethylene sorbitan fatty acid esters.

As an acetylene glycol-type surfactant, there can be provided, for example, 2,4,7,9-tetramethyl-5-decyne-4,7-diol, 3,6-dimethyl-4-octyne-3,6-diol, and 3,5-dimethyl-1-hexyne-3-ol. For the acetylene glycol-type surfactant, there can be provided, for example, Surfynol 104, 82, 465, 485, and TG (available from Air Products and Chemicals, Inc.) as commercial products.

As an amphoteric surfactant, there can be provided, for example, lauryl aminopropionate, lauryl dimethyl betaine, stearyl dimethyl betaine, and lauryl dihydroxyethyl betaine. In addition, there can be provided, for example, lauryldimethylamineoxide, myristyldimethylamineoxide, stearyldimethylamineoxide, dihydroxyethyllaurylamineoxide, polyoxyethylene coconut oil alkyldimethylamineoxide, dimethylalkyl (coconut) betaine, and dimethyl lauryl betaine.

Among these surfactants, surfactants represented by the following chemical formulas (V), (VI), (VII), (VIII), (IX), and (X) are preferable.

$$R1\text{-}O—(CH_2CH_2O)hCH_2COOM \quad (V)$$

In chemical formula (V), R1 is an alkyl group with 6-14 carbon atoms which may be branched. h is an integer of 3-12. M is selected from alkali metal ions, quaternary ammonium ions, quaternary phosphonium ions, and alkanolamines.

(VI)

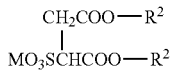

In chemical formula (VI), $R^2$ is an alkyl group with 5-16 carbon atoms which may be branched. M is selected from alkali metal ions, quaternary ammonium ions, quaternary phosphonium ions, and alknolamines.

(VII)

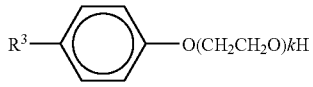

In chemical formula (VII), $R^3$ is a hydrocarbon group such as alkyl groups with 6-14 carbon atoms which may be branched. k is an integer of 5-20.

$$R4\text{-}(OCH_2CH_2)jOH \quad (VIII)$$

In chemical formula (VIII), R4 is a hydrocarbon group such as alkyl groups with 6-14 carbon atoms. j is an integer of 5-20.

(IX)

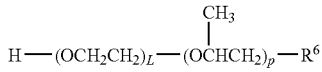

In chemical formula (IX), $R^6$ is a hydrocarbon group such as alkyl groups with 6-14 carbon atoms which may be branched. Each of L and p is independently an integer of 1-20.

(X)

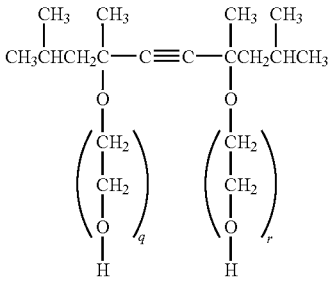

In chemical formula (X), each of q and r is independently an integer of 0-40.

The surfactants represented by chemical formulas (V) and (VI) shown above are specifically provided in the form of a free acid, below. First, as a surfactant of (V), the following ones represented by (V-1) to (V-6) can be provided.

(V-1)

$CH_3(CH_2)_{12}O(CH_2CH_2O)_3CH_2COOH$ (V-2)

$CH_3(CH_2)_{12}O(CH_2CH_2O)_4CH_2COOH$ (V-3)

$CH_3(CH_2)_{12}O(CH_2CH_2O)_5CH_2COOH$ (V-4)

$CH_3(CH_2)_{12}O(CH_2CH_2O)_6CH_2COOH$ (V-5)

$CH_3(CH_2)_{11}CH(CH_3)O(CH_2CH_2O)_6CH_2COOH$ (V-6)

$CH_3(CH_2)_6CH((CH_2)_5CH_3)O(CH_2CH_2O)_3CH_2COOH$

Next, as a surfactant of (VI), the following ones represented by (VI-1) to (VI-4) can be provided.

(VI-1)

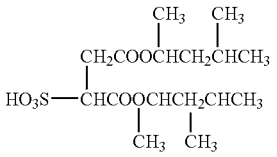

(VI-2)

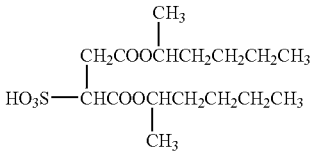

(VI-3)

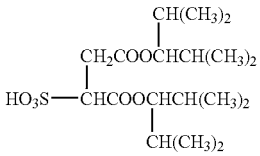

(VI-4)

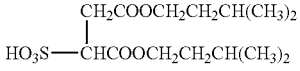

As a fluorinated surfactant, one represented by the following chemical formula (A) is preferable.

$$CF_3CF_2(CF_2CF_2)m\text{-}CH_2CH_2O(CH_2CH_2O)nH \quad (A)$$

In chemical formula (A), m is an integer of 0-10, and n is an integer of 1-40.

As a fluorinated surfactant, there can be provided, for example, perfluoroalkyl sulfonic acid compounds, perfluoroalkyl carboxylic acid compounds, perfluoroalkyl phosphate compounds, perfluoroalkyl ethyleneoxide compounds, and polyoxyalkylene ether polymers having a perfluoroalkyl ether group as a side chain. Among these, a polyoxyalkylene ether polymers having a perfluoroalkyl ether group as a side chain has a low foamability and a low fluorine compound bioaccumulation potential, which is recently considered problematic, and is therefore safety, which is particularly preferable.

As a perfluoroalkyl sulfonic acid compound, there can be provided, for example, perfluoroalkyl sulfonic acids and perfluoroalkyl sulfonates.

As a perfluoroalkyl carboxylic acid compound, there can be provided, for example, perfluoroalkyl carboxylic acids and perfluoroalkyl carboxylates.

Also, as a perfluoroalkyl phosphate compound, there can be provided, for example, esters derived from perfluoroalkyl phosphoric acids and salts of esters of perfluoroalkyl phosphoric acids.

As a polyoxyalkylene ether polymers having a perfluoroalkyl ether group as a side chain, there can be provided, for example, polyoxyalkylene ether polymers having a perfluoroalkyl ether group as a side chain, sulfates of polyoxyalkylene ether polymers having a perfluoroalkyl ether group as a side chain, and salts of a polyoxyalkylene ether polymers having a perfluoroalkyl ether group as a side chain.

As a counter ion of a salt in the fluorinated surfactants described above, there can be provided, for example, Li, Na, K, $NH_4$, $NH_3CH_2CH_2OH$, $NH_2(CH_2CH_2OH)_2$, and $NH(CH_2CH_2OH)_3$.

The fluorinated surfactant may be appropriately synthesized and used or a commercial product may be used.

As a commercial product thereof, there can be provided, for example, Surflon S-111, S-112, S-113, S-121, S-131, S-132, S-141, and S-145 (available from Asahi Glass Co., Ltd.); Fluorad FC-93, FC-95, FC-98, FC-129, FC-135, FC-170C, FC-430, and FC-431 (available from Sumitomo 3M Limited); Megafac F-470, F1405, and F-474(available from Dainippon Ink and Chemicals, Incorporated); Zonyl TBS, FSP, FSA, FSN-100, FSN, FSO-100, FSO, FS-300, UR (available from DuPont); FT-110, FT-250, FT-251, FT-400S, FT-150, FT-400SW (available from NEOS Co. Ltd.); and PF-151N (available from Omnova Solutions, Inc.). Among these, Zonyl FSN, FSO-100, and FSO (available from DuPont) are particularly preferable in terms of high reliability and good color development.

Other components are not particularly limited and can be appropriately selected according to need, and there can be provided, for example, resin emulsions, pH adjustors, antiseptics or fungicides, rust inhibitors, antioxidants, ultraviolet ray absorbers, oxygen absorbers, and light stabilizers.

A resin emulsion is obtained by dispersing a resin fine particle in water as a continuous phase and may contain a dispersing agent such as a surfactant according to need.

Generally, it is preferable that the content of a resin fine particle as a dispersed phase component (the content of a resin fine particle in a resin emulsion) is 10-70% by mass. Also, in regard to the particle diameter of the resin fine particle, the average particle diameter is preferably 10-1,000 nm, and more preferably 20-300 nm, particularly, by taking use in an ink jet recording apparatus into consideration.

The material of the resin fine particle in the dispersed phase is not particularly limited and can be appropriately selected according to the purpose, and there can be provided, for example, acrylic resins, vinyl acetate resins, styrene resins, butadiene resins, styrene-butadiene resins, vinyl chloride resins, acryl-styrene resins, and acryl silicone resins. Among these, acryl silicone resins are particularly preferable.

The resin emulsion may be appropriately synthesized and used or a commercial product may be used.

As a commercially available resin emulsion, there can be provided, for example, Microgel E-1002, E-5002 (styrene-acryl resin emulsions, available from Nippon Paint Co., Ltd.); VONCOAT 4001 (an acrylic resin emulsion, available from Dainippon Ink and Chemicals, Incorporated); VONCOAT 5454 (a styrene-acryl resin emulsion, available from Dainippon Ink and Chemicals, Incorporated); SAE-1014 (a styrene-acryl resin emulsion, available from ZEON Corporation); Saibinol SK-200 (an acrylic resin emulsion, available from Saiden Chemical Industry Co., Ltd.); Primal AC-22, AC-61 (acrylic resin emulsions, available from Rohm and Haas Company); Nanocryl SBCX-2821, 3689 (acryl silicone resin emulsions, available from Toyo Ink Mfg. Co., Ltd.); and #3070 (a methyl methacrylate polymer resin emulsion, available from Mikuni Color Ltd.).

The content of the added resin fine particle component in a resin emulsion in the ink is preferably 0.1-50% by mass, more preferably 0.5-20% by mass, and further preferably 1-10% by mass. If the content is less than 0.1% by mass, the effect of improving the resistance to clogging and the ejection stability may not be sufficient, and if it is greater than 50% by mass, the preservation stability of the ink may be degraded.

The surface tension of a recording liquid used in an image forming apparatus according to the present invention is preferably 10-60 N/m, and more preferably 15-40 N/m from the viewpoint of satisfaction of both the wettability against a recording medium and the formation of a liquid drop particle.

Similarly, the viscosity of a recording liquid is preferably in a range of 1.0-30 mPa·s, and more preferably in a range of 5.0-10.0 mPa·s from the viewpoint of the ejection stability.

Also, the pH of the recording liquid is preferably in a range of 3-11, and more preferably in a range of 6-10 from the viewpoint of the corrosion prevention for a metal part which contacts the liquid.

Also, an antiseptic or a fungicide can be contained in the recording liquid, whereby the growth of bacteria can be suppressed and the preservation stability and image quality stability thereof can be improved. As an antiseptic and fungicide, there can be used, for example, benzotriazole, sodium dehydroacetate, sodium sorbate, 2-pyridinethiol-1-oxide, isothiazolin-based compounds, sodium benzoate, and sodium pentachlorophenolate.

Also, a rust inhibitor can be contained in the recording liquid, whereby a coating can be formed on a metal surface of the head, etc., which contacts the liquid, so as to prevent the corrosion thereof. As a rust inhibitor, there can be used, for example, acidic sulfites, sodium thiosulfate, thiodiglycolic acid ammonium, diisopropyl ammonium nitrite, pentaerythritol tetranitrate, and dicyclohexyl ammonium nitrite.

Also, an antioxidant can be contained in the recording liquid, whereby the antioxidant can quench radical species which can cause corrosion and prevent the corrosion even when the radical species are generated.

As an antioxidant, phenolic compounds and amine compounds are representative. As a phenolic compound, there can be provided, for example, compounds such as hydroquinone and gallates; and hindered phenolic compounds such as 2,6-di-tert-butyl-p-cresol, stearyl β-(3,5-di-tert-butyl-4-hydroxyphenyl)propionate, 2,2'-methylenebis(4-methyl-6-tert-butylphenol), 2,2'-methylenebis(4-ethyl-6-tert-butylphenol), 4,4'-thiobis(3-methyl-6-tert-butylphenol), 1,1,3-tris(2-methyl-4-hydroxy-5-tert-butylphenyl)butane, 1,3,5-trimethyl-2,4,6-tris(3,5-di-tert-4-hydroxybenzyl)benzene, tris(3,5-dit-tert-butyl-4-hydroxybenzyl)isocyanurate, and tetrakis [methylene-3-(3',5'-di-tert-butyl-4-hydroxyphenyl) propionate]methane. As an amine compound, there can be provided, for example, N,N'-diphenyl-p-phenylenediamine, phenyl-β-naphthylamine, phenyl-α-naphthylamine, N,N'-β-naphthyl-p-phenylenediamine, N,N'-diphenylethylenediamine, phenothiazine, N,N'-di-sec-butyl-p-phenylenediamine, and 4,4'-tetramethyl-diaminodiphenylmethane. Also, for the latter, sulfur-containing compounds and phosphorus-containing compounds are representative. As a sulfur-containing compound, there can be provided, for example, dilauryl thiodipropionate, distearyl thiodipropionate, lauryl stearyl thiodipropionate, dimyristyl thiodipropionate, distearyl β,β'-thiodibutyrate, 2-mercaptobenzoimidazole, and dilauryl sulfide. As a phosphorus-containing compound, there can be provided, for example, triphenyl phosphite, trioctadecyl phosphite, tridecyl phosphite, trilauryl trithiophosphite, diphenyl isodecyl phosphite, trinonyl phenyl phosphite, and distearyl pentaerythritol phosphite.

As a pH adjuster contained in the recording liquid, there can be used, for example, hydroxides of alkali metals such as lithium hydroxide, sodium hydroxide, and potassium hydroxide; ammonium hydroxide; quaternary ammonium hydroxides; quaternary phosphonium hydroxides; carbonates of alkali metals such as lithium carbonate, sodium carbonate, and potassium carbonate; amines such as diethanolamine and triethanolamine; boric acid; hydrochloric acid; nitric acid; sulfuric acid; and acetic acid.

As an ultraviolet-ray absorber, there can be provided, for example, benzophenone-based ultraviolet-ray absorbers, benzotriazole-based ultraviolet-ray absorbers, salicylate-type ultraviolet-ray absorbers, cyanoacrylate-type ultraviolet-ray absorbers, and nickel complex-based ultraviolet-ray absorbers.

As a benzophenone-based ultraviolet-ray absorber, there can be provided, for example, 2-hydroxy-4-n-octoxybenzophenone, 2-hydroxy-4-n-dodecyloxybenzophenone, 2,4-dihydroxybenzophenone, 2-hydroxy-4-methoxybenzophenone, and 2,2',4,4'-tetrahydroxybenzophenone.

As a benzotriazole-based ultraviolet-ray absorber, there can be provided, for example, 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

As a salicylate-type ultraviolet-ray absorber, there can be provided, for example, phenyl salicylate, p-tert-butylphenyl salicylate, and p-octylphenyl salicylate.

As a cyanoacrylate-type ultraviolet-ray absorber, there can be provided, for example, ethyl 2-cyano-3,3'-diphenylacrylate, methyl 2-cyano-3-methyl-3-(p-methoxyphenyl)acrylate, and butyl 2-cyano-3-metyl-3-(p-methoxyphenyl)acrylate.

As a nickel complex-type ultraviolet-ray absorber, there can be provided, for example, nickel bis(octylphenyl)sulfide, 2,2'-thiobis(4-tert-octylphalate)-n-butylamine nickel(II), 2,2'-thiobis(4-tert-octylphalate)-2-ethylhexylamine nickel (II), and 2,2'-thiobis(4-tert-octylphalate)triethanolamine nickel(II).

An ink in an ink media set according to the present invention is manufactured by dissolving or dispersing, at least, water, a coloring agent, and a wetting agent, and a penetrating agent and a surfactant according to need, and further another component according to need in an aqueous medium and further stirring and mixing them according to need. The dispersion can be attained by using, for example, a sand mill, a homogenizer, a ball mill, a paint shaker, or an ultrasound dispersing machine and the stirring and mixing can be attained by an usual stirring machine having a stirring blade, a magnetic stirrer, or a high-speed dispersing machine.

The color of ink is not particularly limited and can be appropriately selected according to the purpose, and there can be provided, for example, yellow, magenta, cyan, and black. When an ink set in which at least two kinds of the colors are used in combination is used to perform recording, a multicolor image can be formed, and when an ink set in which all the colors are used in combination is used to perform recording, a full-color image can be formed.

In thus configured image forming apparatus, the paper sheets 112 are fed and separated one by one from the paper feeding part, and the paper sheet 112 fed approximately vertically and upward is guided by the guide 115 and conveyed into the space between the conveyor belt 121 and the counter roller 122. Further, the leading edge of the paper sheet 112 is guided by the conveying guide 123 and pressed by the leading edge pressing roller 125 against the conveyor belt 121, and the conveyance direction of it is changed by approximately 90°.

Then, an alternating voltage such that a positive output and a negative output are alternately repeated is applied to the charging roller 126 from an AC bias applying part by a control circuit which is not shown in the figures and the conveyer belt 121 is charged with an alternating charging voltage pattern, that is, with positively and negatively charged strips with a constant width alternately in the sub-scanning direction which is a rotational direction thereof. When the paper sheet 112 is fed onto and conveyed on the conveyor belt 121 which is positively and negatively charged alternately, the paper sheet 112 is attracted to the conveyor belt 121 by an electrostatic force and the paper sheet 112 is conveyed in the sub-scanning direction according to the rotational movement of the conveyor belt 121.

Then, the recording head 107 is driven according to an image signal while the carriage 103 is moved in the forward and backward directions, and an ink drop is ejected onto the stopping paper sheet 112 to record one line of image. After the paper sheet 112 is conveyed by a specified distance, the next line is recorded. When a recording completion signal or a signal indicating that the bottom edge of the paper sheet 112 has reached an image forming area is received, the recording operation is completed and the paper sheet 112 is ejected onto the ejected paper tray 154.

In the case of double-face printing, when front face (first printing face) recording is completed, the recorded paper sheet 112 is sent into a double-face paper feeding unit 155 by counter-rotating the conveyor belt 121, and the paper sheet 112 is reversed (such that the back face thereof is a face to be printed) and fed into the space between the counter roller 122 and the conveyer belt 121 again. After it is conveyed on the conveyer belt 121 similarly to as described above and recording is performed on the back face by timing control, it is ejected on the ejected paper tray 154.

Also, during standby for printing (recording), the carriage 103 is moved to the side of the maintenance and refreshing mechanism 155 and the nozzle face of the recording head 107 is capped by the cap 157, whereby the nozzle is kept at a wetting condition and ejection failure caused by dried ink is prevented. Also, while the recording head 107 is capped by the cap 157, recording liquid is suctioned by the nozzle (which is called as "nozzle suction" or "head suction") and a refreshing operation to eliminate thickened recording liquid or air bubbles is conducted. Then, wiping is conducted by using the wiper blade 158 in order to wipe off or remove the ink adhering to the nozzle face of the recording head 107 during the refreshing operation. Also, before or during the recording, blank ejection operation for ejecting ink which is not associated with the recording is conducted. Thereby, the stable ejection performance of the recording head 107 is maintained.

Thus, in the image forming apparatus including the liquid drop ejecting device, since the recording head composed of the liquid ejecting head according to the present invention is included, a high quality image can be formed.

Herein, when the used recording liquid is a dye-containing ink in which a dye is used as a coloring material, the temperature for heat treatment to form an ink-resistant liquid contact film tends to be higher, but, since thallium is contained, the heat shrinkage caused by the heat treatment hardly occurs and a component of the head can be formed with a good precision of a dimension thereof. Also, in the case of a pigment-containing ink in which a pigment is used as a coloring agent, since the temperature for heat treatment to form an ink-resistant liquid contact film tends to be lower than the case where a dye-containing ink is used, the heat shrinkage caused by the heat treatment further hardly occurs and a component of the head can be formed with a good precision of a dimension thereof.

Furthermore, in the case of an ink containing a pigment coated with a resin, since no heat treatment process for forming an ink-resistant liquid contact film is required, no heat shrinkage occurs and a component of the head can be formed with a good precision of a dimension thereof. Also, when benzotriazole as a rust inhibitor is contained in an ink, the temperature for heat treatment to form an ink-resistant liquid contact film can be lowered and a component of the head can be formed with a good precision of a dimension thereof.

Figure 16:
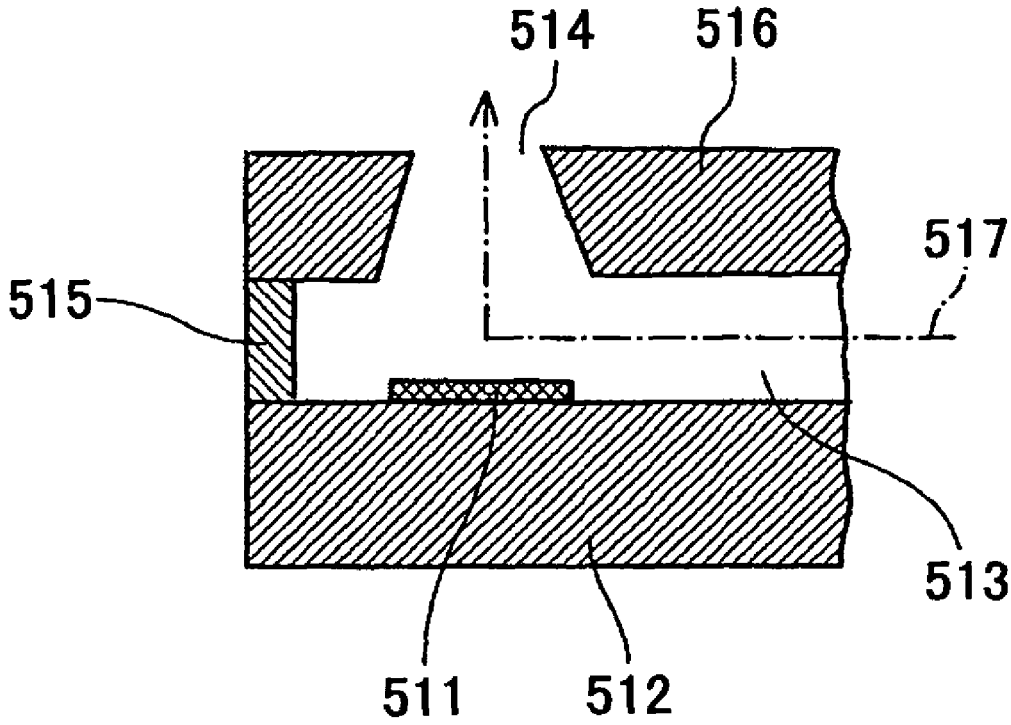
FIG. 16 is a cross-sectional diagram illustrating the essential part of another example of a liquid ejecting head.

Next, as a liquid ejecting head, example of a thermal-type head is described with reference to FIG. 16, which is a side-shooter-type head whose liquid drop ejecting direction is different from the directions of the flow channel for recording liquid (liquid chamber) and which head is similar to the liquid ejecting head of the aforementioned embodiment, but a device for generating energy to eject a liquid drop (driving element) is an electro-thermal converter.

The liquid ejecting head is constructed by stacking a flow channel forming member 515 constituting a side wall for a flow channel 513 on a substrate 512 having an ejection energy generator 511 (in which electrodes for applying an ejection signal to the generator and a protective layer provided on the generator according to need are omitted) and stacking a nozzle plate 516 on which a nozzle 514 is formed, on the flow channel forming member 515. In this head, the direction of ink flow to the ejection energy acting part in the flow channel 513 is perpendicular to the central axis of the opening of the nozzle 514, as shown by a dashed line 517.

By employing a head with such a configuration, energy generated from the ejection energy generator 511 can be more efficiently converted into kinetic energy for the formation of an ink drop and the traveling thereof. Also, there is a structural advantage of high-speed recovery of the meniscus of ink by supply of ink and it is particularly effective when a heater element is used for the ejection energy generator. Also, the side shooter-type one can avoid so-called cavitation phenomenon, such that an ejection energy generator is gradually destroyed by a shock caused by decay of air bubbles, which is problematic in an edge shooter. That is, in the side-shooter type one, if an air bubble develops and the air bubble reaches the nozzle, the air bubble communicates with atmosphere and no shrinkage of the air bubble is caused by temperature drop, so that the lifetime of the head can be relatively long.

Even in the head having no vibrating plate such as this liquid ejecting head, the embrittlement and heat shrinkage in the heat treatment process can be reduced by applying the present invention to a nozzle plate, a flow channel plate, etc., so as to obtain a liquid ejecting head with a high precision.

Additionally, although the aforementioned embodiment of the present invention has been described with respect to an example such that the present invention is applied to an image forming apparatus configured as a printer, but the present invention is not limited to this embodiment and can be also applied to, for example, another image forming apparatus such as a printer/facsimile/copia multi-function processing machine. Also, the present invention can be applied to an image forming apparatus using, for example, another recording liquid which is liquid except ink or fixation treatment liquid.

Next, a recording method according to the present invention is described. In the recording method according to the present invention, an image is recorded on a recording medium (paper sheet) by ejecting a liquid drop from the liquid ejecting head according to the present invention, as in the image forming apparatus described above.

Now, first, the relationship among a nozzle plate of a liquid ejecting head according to the present invention, recording liquid (herein, ink) and a recording medium (called a medium) is described. As described above, the nozzle plate of the liquid ejecting head according to the present invention is excellent in water repellency and ink repellency and, therefore, can form an ink drop (a particle) well, even when an ink with a low surface tension is used. This is because the nozzle plate is not excessively wetted and the meniscus of ink is formed normally. As the meniscus is formed normally, ink is prevented from being drawn to one side when the ink is ejected, and, consequently, bending of an ink stream can be reduced and an image can be obtained with a high accuracy of a dot position.

When printing is made on a paper sheet (medium) with a low absorbency, the degree of the positional accuracy of a dot significantly affects an image quality. That is, since ink does not smoothly spread on a paper sheet with a low absorbency, an area with no filled ink, namely, a blank portion is formed even if the positional accuracy of a dot is only slightly lowered. This area with no filled ink causes the irregularity or decrease of the image density, which leads to the degradation of the image quality.

However, in a nozzle plate of the liquid ejecting head according to the present invention, since the positional accuracy of a dot is high even if an ink with low surface tension is used, the ink can be filled in a paper sheet even when a paper sheet with low absorbency is used, whereby the irregularity or decrease of the density of an image is not caused and a print with a high image quality can be obtained.

A recording medium (medium for recording) used in the recording method according to the present invention is described below.

The recording medium includes a supporter and a coating layer on at least one surface of the supporter, and further includes another layer according to need.

As a medium for recording, the amount of ink as recording liquid transferred into a used medium for recording for contact time of 100 ms, which amount is measured by a dynamic scanning absorptometer, is 4-15 ml/m$^2$, and more preferably 6-14 ml/m$^2$. Similarly, the amount of pure water transferred into a used medium for recording for contact time of 100 ms, which amount is measured by a dynamic scanning absorptometer, is preferably 4-26 ml/m$^2$, and more preferably 8-25 ml/m$^2$. In regard to a medium for recording, if the amount of transferred pure ink or water for contact time of 100 ms is too small, beading may easily occur, and if it is too large, the diameter of a recorded ink dot may be excessively smaller than a desired diameter.

Also, as a medium for recording, the amount of ink transferred into a used medium for recording for contact time of 400 ms, which amount is measured by a dynamic scanning absorptometer, is 7-20 ml/m$^2$, and more preferably 8-19 ml/m$^2$. Similarly, the amount of pure water transferred into a used medium for recording for contact time of 400 ms, which amount is measured by a dynamic scanning absorptometer, is preferably 5-29 ml/m$^2$, and more preferably 10-28 ml/m$^2$. In regard to a medium for recording, if the amount of transferred one for contact time of 400 ms is too small, the drying property thereof may be insufficient and a spur mark may be created, and if it is too large, bleeding may easily occur and the glossiness of an image portion after drying may be low.

Herein, the dynamic scanning absorptometer (DSA: JAPAN TAPPI JOURNAL, Volume 48, May 1994, pp. 88-92, Shigenori Kuga) is an apparatus which can accurately measure the amount of a liquid absorbed during a very short period of time. The dynamic scanning absorptometer performs an automatic measurement by directly reading the speed of liquid absorption based on the movement of the meniscus thereof in a capillary, shaping a sample into a disc, spirally scanning it with an liquid-absorbing head, and automatically controlling the scanning speed in accordance with a predetermined pattern so as to conduct the measurement with respect to the necessary number of point(s) on one sample. A liquid supplying head for supplying liquid onto a paper sample is connected via a Teflon (registered trademark) tube to the capillary, and thee position of the meniscus in the capillary is automatically detected by an optical sensor. Specifically, a dynamic scanning absorptometer (K350 series, type D, available from Kyowa Co., Ltd.) was used to measure the amount of transferred pure water or ink. The amount of transferred one for contact time of 100 ms or 400 ms is obtained by interpolating measurement values of transfer amounts measured for contact time periods around each contact time. The measurement was performed at 23° C. and 50% RH.

<Supporter>

Various materials may be used for the supporter depending on the purpose of paper. For example, a sheet of paper mainly made of wood fibers and a nonwoven fabric mainly made of wood and synthetic fibers may be used.

A sheet of paper may be made of wood pulp or recycled pulp. Examples of wood pulp are leaf bleached kraft pulp (LBKP), needle bleached kraft pulp (NBKP), NBSP, LBSP, GP, and TMP.

As materials of recycled pulp, recycled papers in the list of standard qualities of recycled papers of the Paper Recycling Promotion Center may be used. For example, chemical pulp or high-yield pulp made of recycled papers may be used as the supporter. Such recycled papers include printer papers such as non-coated computer paper, thermal paper, and pressure-sensitive paper; OA papers such as plain paper; coated papers such as art paper, ultra-lightweight coated paper, and matt paper; and non-coated papers such as bond paper, color bond paper, note paper, letter paper, wrapping paper, fancy paper, medium quality paper, newspaper, woody paper, supermarket flyers, simili paper, pure-white roll paper, and milk cartons. The above materials may be used individually or in combination.

Normally, recycled pulp is made by the following four steps:

(1) A defibrating step of breaking down used paper into fibers and separating ink from the fibers by using a mechanical force and a chemical in a pulper.

(2) A dust removing step of removing foreign substances (such as plastic) and dust in the used paper by using, for example, a screen and a cleaner.

(3) A deinking step of expelling the ink separated by a surfactant from the fibers by using a flotation method or a cleaning method.

(4) A bleaching method of bleaching the fibers by oxidization or reduction.

When mixing recycled pulp with wood pulp, the percentage of recycled pulp is preferably 40% or lower so that produced paper does not curl after recording.

As an internal filler for the supporter, a conventional white pigment may be used. For example, the following substances may be used as a white pigment: an inorganic pigment such as precipitated calcium carbonate, heavy calcium carbonate, kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic silica, aluminum hydroxide, alumina, lithophone, zeolite, magnesium carbonate, or magnesium hydrate; and an organic pigment such as styrene plastic pigment, acrylic plastic pigment, polyethylene, microcapsule, urea resin, or melamine resin. The above substances may be used individually or in combination.

As an internal sizing agent used when producing the supporter, a neutral rosin size used for neutral papermaking, alkenyl succinic anhydride (ASA), alkyl ketene dimer (AKD), or a petroleum resin size may be used. Especially, a neutral rosin size and alkenyl succinic anhydride are preferable. Alkyl ketene dimer has a high sizing effect and therefore provides an enough sizing effect with a small amount. However, since alkyl ketene dimer reduces the friction coefficient of the surface of recording paper (medium), recording paper made using alkyl ketene dimer may cause a slip when being conveyed in an ink jet recording apparatus.

<Coating Layer>

The coating layer contains a pigment and a binder, and may also contain a surfactant and other components.

As a pigment, an inorganic pigment or a mixture of an inorganic pigment and an organic pigment may be used.

For example, kaolin, talc, heavy calcium carbonate, precipitated calcium carbonate, calcium sulfite, amorphous silica, alumina, titanium white, magnesium carbonate, titanium dioxide, aluminum hydroxide, calcium hydrate, magnesium hydrate, zinc hydroxide, or chlorite may be used as an inorganic pigment. Especially, kaolin provides a high gloss surface similar to that of an offset paper and is therefore preferable.

There are several types of kaolin, for example, delaminated kaolin, calcined kaolin, and engineered kaolin made by surface modification. To provide a high gloss surface, the mass percentage of a type of kaolin, in which 80 or more mass percent of particles have a diameter of 2 μm or smaller, in the total amount of kaolin is preferably 50 percent or more.

The mass ratio of the binder to kaolin in the coating layer is preferably 100:50. If the mass ratio of kaolin is lower than 50, sufficient glossiness may not be obtained. There is no specific limit to the amount of kaolin. However, when the fluidity and the thickening property of kaolin under a high shearing force are taken into account, the mass ratio of kaolin is preferably 90 or lower in terms of coatability.

As an organic pigment, a water-soluble dispersion of, for example, styrene-acrylic copolymer particles, styrene-butadiene copolymer particles, polystyrene particles, or polyethylene particles may be used. The above organic pigments may be used in combination.

The amount of an organic pigment in the total amount of pigment in the coating layer is preferably 2-20 mass percent. An organic pigment as described above has a specific gravity lower than that of an inorganic pigment and therefore provides a thick, high-gloss coating layer having a good coatability. If the mass percentage of an organic pigment is less than 2 percent, a desired effect is not obtained. If the mass percentage of an organic pigment is more than 20 percent, the fluidity of a coating liquid becomes too low and, as a result, the efficiency of a coating process decreases and the operational costs increase.

Organic pigments can be divided into several types according to their particle shapes: solid-shape, hollow-shape, and doughnut-shape. To achieve a good balance between the glossiness, coatability, and fluidity of a coating liquid, an organic pigment having hollow-shaped particles with a void percentage of 40 percent or higher and an average diameter of between 0.2 and 3.0 μm is preferable.

As a binder, a water-based resin is preferably used.

As a water-based resin, a water-soluble resin or a water-dispersible resin may be used. Any type of water-based resin may be used depending on the purpose. For example, the following water-based resins may be used: polyvinyl alcohol; a modified polyvinyl alcohol such as anion-modified polyvinyl alcohol, cation-modified polyvinyl alcohol, or acetal-modified polyvinyl alcohol; polyurethane; polyvinyl pyrrolidone; a modified polyvinyl pyrrolidone such as polyvinyl pyrrolidone-vinyl acetate copolymer, vinyl pyrrolidone-dimethylaminoethyl methacrylate copolymer, quaternized vinyl pyrrolidone-dimethylaminoethyl methacrylate copolymer, or vinyl pyrrolidone-methacrylamide propyl trimethyl ammonium chloride copolymer; cellulose such as carboxymethyl cellulose, hydroxyethyl cellulose, or hydroxypropylcellulose; modified cellulose such as cationized hydroxyethyl cellulose; polyester, polyacrylic acid (ester), melamine resin, or modified versions of these substances; synthetic resin made of polyester-polyeurethane copolymer; and other substances such as poly(metha)acrylic acid, poly(metha)acrylamide, oxidized starch, phosphorylated starch, self-denatured starch, cationized starch, other modified starches, polyethylene oxide, polyacrylic acid soda, and alginic acid soda. The above substances may be used individually or in combination.

Among the above substances, polyvinyl alcohol, cation-modified polyvinyl alcohol, acetal-modified polyvinyl alcohol, polyester, polyurethane, and polyester-polyeurethane copolymer are especially preferable in terms of ink-absorption rate.

Any type of water-dispersible resin may be used depending on the purpose. For example, the following water-dispersible resins may be used: polyvinyl acetate, ethylene-polyvinyl acetate copolymer, polystyrene, styrene-(metha)acrylic ester copolymer, (metha)acrylic ester polymer, polyvinyl acetate-(metha)acrylic acid (ester) copolymer, styrene-butadiene copolymer, an ethylene-propylene copolymer, polyvinyl ether, and silicone-acrylic copolymer. A water-dispersible resin may contain a cross-linking agent such as methylol melamine, methylol hydroxypropylene urea, or isocyanate. Also, a self-crosslinking copolymer containing a unit of methylol acrylamide may be used as a water-dispersible resin. Two or more of the water-dispersible resins described above may be used at the same time.

The mass ratio of the water-based resin to the pigment in the coating layer is preferably 2:100 to 100:100, and more preferably 3:100 to 50:100. The amount of the water-based resin in the coating layer is determined so that the liquid-absorption rate of a recording medium falls within a specific range.

When a water-dispersible colorant is used, whether to mix a cationic organic compound in the binder is optional. For example, primary to tertiary amines that react with sulfonic groups, carboxyl groups, or amino groups of a direct dye or an acid dye in a water-soluble ink, and form insoluble salt; or a monomer, oligomer, or polymer of quarternary ammonium salt may be used. Among them, an oligomer and a polymer of quarternary ammonium salt are especially preferable.

As a cationic organic compound, the following substances may be used: dimethylamine-epichlorohydrin polycondensate, dimethylamine-ammonia-epichlorohydrin condensate, poly(trimethyl aminoethyl-methacrylate methylsulfate), diallylamine hydrochloride-acrylamide copolymer, poly(diallylamine hydrochloride-sulfur dioxide), polyallylamine hydrochlorid, poly(allylamine hydrochloriddiallylamine hydrochloride), acrylamide-diallylamine copolymer, polyvinylamine copolymer, dicyandiamide, dicyandiamide-ammonium chloride-urea-formaldehyde condensate, polyalkylene polyamine-dicyandiamide ammonium salt consensate, dimethyl diallyl ammonium chloride, poly(diallyl methyl amine) hydrochloride, poly(diallyl dimethyl ammonium chloride), poly(diallyl dimethyl ammonium chloride-sulfur dioxide), poly(diallyl dimethyl ammonium chloride-diallyl amine hydrochloride derivative), acrylamide-diallyl dimethyl ammonium chloride copolymer, acrylate-acrylamide-diallyl amine hydrochloride copolymer, polyethylenimine, ethylenimine derivative such as acrylamine polymer, and modified polyethylenimine alkylene oxide. The above substances may be used individually or in combination.

It is preferable to use a cationic organic compound with a low-molecular weight such as dimethylamine-epichlorohydrin polycondensate or polyallylamine hydrochlorid and a cationic organic compound with a relatively-high molecular weight such as poly(diallyl dimethyl ammonium chloride) in combination. Compared with a case where only one cationic organic compound is used, using cationic organic compounds in combination improves image density and reduces feathering.

The equivalent weight of cation in a cationic organic compound obtained by the colloid titration method (performed using polyvinyl potassium sulfate and toluidine blue) is preferably between 3 and 8 meq/g. With an equivalent weight in the above range, the dry deposit mass of the cationic organic compound falls within a preferable range. In the measurement of the equivalent weight of cation, the cationic organic compound is diluted with distillated water so that the solid content in the solution becomes 0.1 mass percent. No pH control is performed.

The dry deposit mass of the cationic organic compound is preferably between 0.3 and 2.0 g/m$^2$. If the dry deposit mass of the cationic organic compound is lower than 0.3 g/m$^2$, sufficient improvement in image density and sufficient reduction in feathering may not be achieved.

Any surfactant may be used depending on the purpose. For example, an anion surfactant, a cation surfactant, an amphoteric surfactant, or a nonionic surfactant may be used. Among the above surfactants, a nonionic surfactant is especially preferable. Adding a surfactant improves water resistance and density of an image, and thereby reduces bleeding.

For example, the following nonionic surfactants may be used: higher alcohol ethylene oxide adduct, alkylphenol ethylene oxide adduct, fatty acid ethylene oxide adduct, polyhydric alcohol fatty acid ester ethylene oxide adduct, higher aliphatic amine ethylene oxide adduct, fatty acid amide ethylene oxide adduct, fatty oil ethylene oxide adduct, ethylene oxide adduct of fat, polypropylene glycol ethylene oxide adduct, glycerol fatty acid ester, pentaerythritol fatty acid ester, sorbitol-sorbitan fatty acid ester, sucrose fatty acid ester, polyhydric alcohol alkyl ether, and alkanolamine fatty acid amide. The above substances may be used individually or in combination.

Polyhydric alcohol is not limited to a specific type and any type of polyhydric alcohol may be used depending on the purpose. For example, glycerol, trimethylolpropane, pentaerythrite, sorbitol, or surcose may be used. Ethylene oxide adduct may be made by replacing a part of ethylene oxide with an alkylene oxide such as propylene oxide or butylene oxide to the extent that the water solubility is not affected. The percentage of the replaced part is preferably 50 percent or lower. The hydrophile-lipophile balance (HLB) of a nonionic surfactant is preferably between 4 and 15, and more preferably between 7 and 13.

The mass ratio of the surfactant to the cationic organic compound is preferably 0:100 to 10:100, and more preferably 0.1:100 to 1:100.

Other components may also be added to the coating layer to the extent that its advantageous effects are not undermined. Examples of other components include additives such as an alumina powder, a pH adjuster, an antiseptic agent, and an antioxidant.

The method of forming the coating layer is not limited to a specific method. For example, the coating layer may be formed by impregnating the supporter with a coating liquid or by applying a coating liquid to the supporter. For the impregnation or application of a coating liquid, a coater such as a conventional size press, a gate roll size press, a film transfer size press, a blade coater, a rod coater, an air knife coater, or a curtain coater may be used. Also, using a conventional size press, a gate roll size press, or a film transfer size press attached to a paper machine for the impregnation or application of a coating liquid may improve the efficiency of the process.

There is no specific limit to the amount of a coating liquid on the supporter. However, the solid content of a coating liquid on the supporter is preferably between 0.5 and 20 g/m$^2$, and more preferably between 1 and 15 g/m$^2$. After the impregnation or application of a coating liquid, the coating liquid may be dried. The temperature for this drying process is preferably between 100 and 250° C., but is not limited to the specific range.

The exemplary recording medium used in the recording method of the present invention may also have a back layer on the back of the supporter, and other layers between the supporter and the coating layer or between the supporter and the back layer. Also, a protective layer may be provided on the coating layer. Each of the layers may be composed of one layer or multiple layers.

In the case that absorbency of liquid is within the above range of invention, the recording medium used in the recording method of the present invention may be commercially available coated paper for offset printing, coated paper for gravure other than recording medium used for ink jet.

It is preferable that grammage of the recording medium used in the recording method of the present invention is between 50 and 250 g/m$^2$. When it is less than 50 g/m$^2$, it is easy to produce poor transportation that the recording medium is clogged on the way of a transportation course so that there is no strength. When the grammage of the recording medium is over than 250 g/m$^2$, the recording medium cannot finish turning in a curve part on the way of the transportation course so that the strength of paper becomes too strong thereby it is easy to produce poor transportation that the recording medium is clogged.

Next, specific practical examples are described. However, the present invention is not limited to these practical examples.

PREPARATION EXAMPLE 1

-Preparation of a Polymer Fine Particle Dispersion Containing a Copper Phthalocyanine Pigment- After the content in a 1 L flask with a mechanical stirrer, a thermometer, a nitrogen gas inlet tube, a reflux tube, and a dropping funnel was sufficiently replaced by nitrogen gas, it was charged with 11.2 g of styrene, 2.8 g of acrylic acid, 12.0 g of lauryl methacrylate, 4.0 g of poly(ethylene glycol methacrylate), 4.0 g of a styrene macromer (available from Toagosei Co., Ltd., commercial name: AS-6), and 0.4 g of mercaptoethanol and the temperature thereof was raised to 65° C. Then, a mixed solution of 100.8 g of styrene, 25.2 g of acrylic acid, 108.0 g of lauryl methacrylate, 36.0 g of poly(ethylene glycol methacrylate), 60.0 g of hydroxyethyl methacrylate, 36.0 g of a styrene macromer (available from Toagosei Co., Ltd., commercial name: AS-6), 3.6 g of mercaptoethanol, 2.4 g of azobis(dimethylvaleronitrile), and 18 g of methyl ethyl ketone was dropped into the 1 L flask for 2.5 hours.

After the dropping was completed, a mixed solution of 0.8 g of azobis(dimethylvaleronitrile) and 18 g of methyl ethyl ketone was dropped into the flask for 0.5 hours. After the maturation at temperature of 65° C. for 1 hour, 0.8 g of azobis(dimethylvaleronitrile) was added and further maturation for 1 hour was conducted. After the completion of the reaction, 364 g of methyl ethyl ketone was put into the flask so as to obtain 800 g of a polymer solution with a concentration of 50% by mass. Then, a portion of the polymer solution was dried and the weight-average molecular weight (Mw) thereof which was measured by means of gel permeation chromatography (standard: polystyrene, solvent: tetrahydrofuran) was 15,000.

Next, 28 g of the obtained polymer solution, 26 g of a copper phthalocyanine pigment, 13.6 g of 1 mol/L aqueous solution of potassium hydroxide, 20 g of methyl ethyl ketone, and 30 g of ion-exchanged water were mixed and stirred sufficiently. Subsequently, kneading using a tripole roll mill (available from Noritake Co., Limited, commercial name: NR-84A) was made 20 times. After the obtained paste was thrown into 200 g of ion-exchanged water and sufficient stirring was made, methyl ethyl ketone and water were evaporated using an evaporator to obtain 160 g of a blue-color polymer-fine-particle dispersion with a solid content of 20.0% by mass.

The average particle diameter (D50%) of the obtained polymer fine particles which was measured by a particle size distribution analyzer (Microtrac UPA, available from Nikkiso Co., Ltd.) was 93 nm.

PREPARATION EXAMPLE 2

-Preparation of a Polymer Fine Particle Dispersion Containing a Dimethylquinacridone Pigment- A magenta-color polymer fine particle dispersion was prepared similarly to preparation example 1 except that the copper phthalocyanine pigment was replaced by C. I. Pigment Red 122 in preparation example 1.

The average particle diameter (D50%) of the obtained polymer fine particles which was measured by a particle size distribution analyzer (Microtrac UPA, available from Nikkiso Co., Ltd.) was 127 nm.

PREPARATION EXAMPLE 3

-Preparation of a Polymer Fine Particle Dispersion Containing a Monoazo Yellow Pigment- A yellow-color polymer fine particle dispersion was prepared similarly to preparation example 1 except that the copper phthalocyanine pigment was replaced by C. I. Pigment Yellow 74 in preparation example 1.

The average particle diameter (D50%) of the obtained polymer fine particles which was measured by a particle size distribution analyzer (Microtrac UPA, available from Nikkiso Co., Ltd.) was 76 nm.

PREPARATION EXAMPLE 4

-Preparation of a Dispersion of Carbon Black Treated with a Sulfonating Agent-

After 150 g of a commercially available carbon black pigment (available from Degussa, "Printex #85") was well mixed in 400 ml of sulfolane and micro-dispersed by a beads mill, 15 g of amidesulfuric acid was added and stirring at 140-150° C. was made for 10 hours. The obtained slurry was thrown into 1000 ml of ion-exchanged water and a surface-treated carbon black wet cake was obtained by using a centrifugal machine at 12,000 rpm. A black carbon dispersion was obtained by re-dispersing the obtained carbon black wet cake in 2,000 ml of ion-exchanged water, adjusting the pH thereof with lithium hydroxide, desalting and concentrating it through an ultrafiltration film so as to obtain a carbon black dispersion with a pigment concentration of 10% by mass, and filtrating it through a nylon filter with an average pore diameter of 1 μm.

The average particle diameter (D50%) of the obtained and dispersed carbon black which was measured by a particle size distribution analyzer (Microtrac UPA, available from Nikkiso Co., Ltd.) was 80 nm.

PRODUCTION EXAMPLE 1

-Production of a Cyan Ink- 20.0% by mass of the polymer fine particle dispersion containing a copper phthalocyanine pigment prepared in preparation example 1, 23.0% by mass of 3-methyl-1,3-butanediol, 8.0% by mass of glycerin, 2.0% by mass of 2-ethyl-1,3-hexanediol, 2.5% by mass of FS-300 (available from DuPont) as a fluorine-containing surfactant, 0.2% by mass of Proxel LV (available from Avecia KK) as an antiseptic or fungicide, and 0.5% by mass of 2-amino-2-ethyl-1,3-propanediol were added into a certain amount of ion-exchanged water (100% by mass in total), and subsequently, filtration through a membrane filter with an average pore diameter of 0.8 μm was made. Thus, a cyan ink was prepared.

PRODUCTION EXAMPLE 2

-Production of a Magenta Ink- 20.0% by mass of the polymer fine particle dispersion containing a dimethylquinacridone pigment prepared in preparation example 2, 22.5% by mass of 3-methyl-1,3-butanediol, 9.0% by mass of glycerin, 2.0% by mass of 2-ethyl- 1,3-hexanediol, 2.5% by mass of FS-300 (available from DuPont) as a fluorine-containing surfactant, 0.2% by mass of Proxel LV (available from Avecia KK) as an antiseptic or fungicide, and 0.5% by mass of 2-amino-2-ethyl-1,3-propanediol were added into a certain amount of ion-exchanged water (100% by mass in total), and subsequently, filtration through a membrane filter with an average pore diameter of 0.8 μn was made. Thus, a magenta ink was prepared.

PRODUCTION EXAMPLE 3

-Production of a Yellow Ink- 20.0% by mass of the polymer fine particle dispersion containing a monoazo yellow pigment prepared in preparation example 3, 24.5% by mass of 3-methyl-1,3-butanediol, 8.0% by mass of glycerin, 2.0% by mass of 2-ethyl-1,3-hexanediol, 2.5% by mass of FS-300 (available from DuPont) as a fluorine-containing surfactant, 0.2% by mass of Proxel LV (available from Avecia KK) as an antiseptic or fungicide, and 0.5% by mass of 2-amino-2-ethyl-1,3-propanediol were added into a certain amount of ion-exchanged water (100% by mass in total), and subsequently, filtration through a membrane filter with an average pore diameter of 0.8 μm was made. Thus, a yellow ink was prepared.

PRODUCTION EXAMPLE 4

-Production of a Black Ink- 20.0% by mass of the carbon black dispersion prepared in preparation example 4, 22.5% by mass of 3-methyl-1,3-butanediol, 7.5% by mass of glycerin, 2.0% by mass of 2-pyrrolidone, 2.0% by mass of 2-ethyl-1,3-hexanediol, 2.5% by mass of FS-300 (available from DuPont) as a fluorine-containing surfactant, 0.2% by mass of Proxel LV (available from Avecia KK) as an antiseptic or fungicide, and 0.5% by mass of 2-amino-2-ethyl-1,3-propanediol were added into a certain amount of ion-exchanged water (100% by mass in total), and subsequently, filtration through a membrane filter with an average pore diameter of 0.8 μm was made. Thus, a black ink was prepared.

Next, the surface tension and viscosity of each ink obtained in production examples 1-4 were measured as follows. The results are shown in Table 1.

<Measurement of Viscosity>

The viscosity was measured at 25° C. by using R-500 Viscometer (available from Toki Sangyo Co., Ltd.) on the conditions of cone 1° 34'×R24, 60 rpm, and after 3 minutes.

<Measurement of Surface Tension>

In regard to the surface tension, the static surface tension thereof was measured at 25° C. by using a surface tensiometer (available from Kyowa Interface Science Co., Ltd., CBVP-Z) and a platinum plate.

TABLE 1

| | Viscosity (mPa · s) | Surface tension (mN/m) |
|---|---|---|
| Production example 1 | 8.05 | 25.4 |
| Production example 2 | 8.09 | 25.4 |
| Production example 3 | 8.11 | 25.7 |
| Production example 4 | 8.24 | 25.4 |

-Production of a Supporter-

A supporter with a weight of 79 g/m$^2$ was produced by making 0.3% by mass of a slurry with the following formulation into a paper using a fourdrinier paper machine. Additionally, in a size press step of a paper making process, an aqueous solution of an oxidized starch was applied such that the adhering solid content was 1.0 g/m$^2$ per one face.

Leaf bleached kraft pulp (LBKP) . . . 80 parts by mass

Needle bleached kraft pulp (NBKP) . . . 20 parts by mass

Precipitated calcium carbonate (commercial name: TP-121, available from Okutama Kogyo Co., Ltd.) . . . 10 parts by mass Aluminum sulfate . . . 1.0 part by mass Amphoteric starch (commercial name: Cato3210, available from Nippon NSC Ltd.) . . . 1.0 part by mass Neutral rosin sizing agent (commercial name: NeuSize M-10, available from Harima Chemicals, Inc.) . . . 0.3 parts by mass Yield improving agent (commercial name: NR-11LS, available from HYMO Co., Ltd.) . . . 0.02 parts by mass

PRODUCTION EXAMPLE 1

-Production of Medium 1 for Recording-

A coating liquid with a solid content concentration of 60% by mass was prepared by adding 70 parts by mass of a clay as a pigment in which clay the rate of particles with a diameter of 2 μm or less was 97% by mass, 30 parts by mass of heavy calcium carbonate with an average particle diameter of 1.1 μm, 8 parts by mass of a styrene-butadiene copolymer emulsion as an adhesive in which the glass-transition temperature (Tg) was −5° C., 1 part by mass of phosphated starch, and 0.5 parts by mass of calcium stearate as an auxiliary into water.

The obtained coating liquid was applied on both sides of the produced supporter described above by using a blade coater so that the adhering solid content was 8 g/m$^2$ per one face, and was dried by hot air and subsequently stepwise supercalendered, to produce "medium 1 for recording".

PRODUCTION EXAMPLE 2

-Production of Medium 2 for Recording-

A coating liquid with a solid content concentration of 60% by mass was prepared by adding 70 parts by mass of a clay as a pigment in which clay the rate of particles with a diameter of 2 μm or less was 97% by mass, 30 parts by mass of heavy calcium carbonate with an average particle diameter of 1.1 μm, 7 parts by mass of a styrene-butadiene copolymer emulsion as an adhesive in which the glass-transition temperature (Tg) was −5° C., 0.7 parts by mass of phosphated starch, and 0.5 parts by mass of calcium stearate as an auxiliary into water.

The obtained coating liquid was applied on both sides of the produced supporter described above by using a blade coater so that the adhering solid content was 8 g/m$^2$ per one face, and was dried by hot air and subsequently stepwise supercalendered, to produce "medium 2 for recording".

PRACTICAL EXAMPLE 1

-An Ink Set, a Medium for Recording, and Image Recording-

An "ink set 1" was prepared according to an conventional method which was composed of the black ink produced in production example 4, the yellow ink produced in production example 3, the magenta ink produced in production example 2, and the cyan ink produced in production example 1.

Character printing was performed by using obtained ink set 1, medium 1 for recording, and a 300 dpi drop on-demand printer experimental machine having a nozzle with a nozzle resolution of 384 on the conditions of an image resolution of 600 dpi and a largest ink drop size of 18 pl. While the adhesion quantity was controlled such that the total amount of a secondary color was controlled to 140%, a solid-color image and a character were printed so as to obtain an image print.

PRACTICAL EXAMPLE 2

-An Ink Set, a Medium for Recording, and Image Recording-

Image printing was conducted similarly to practical example 1 except that medium 2 for recording was used as a medium for recording in practical example 1, whereby an image print was obtained.

PRACTICAL EXAMPLE 3

-An Ink Set, a Medium for Recording, and Image Recording-

Image printing was conducted similarly to practical example 1 except that a commercially available coated paper for gravure printing (commercial name: Space DX, weight=56 g/m$^2$, available from Nippon Paper Industries Co., Ltd.) (hereafter referred to as "medium 3 for recording") was used as a medium for recording in practical example 1, whereby an image print was obtained.

COMPARISON EXAMPLE 1

-An Ink Set, a Medium for Recording, and Image Recording-

Image printing was conducted similarly to practical example 1 except that a commercially available coated paper for offset printing (commercial name: Aurora Coat, weight=104.7 g/m$^2$, available from Nippon Paper Industries Co., Ltd., hereinafter referred to as "medium 4 for recording") was used as a medium for recording in practical example 1, whereby an image print was obtained.

COMPARISON EXAMPLE 2

-An Ink Set, a Medium for Recording, and Image Recording-

Image printing was conducted similarly to practical example 1 except that a commercially available mat coated paper for ink jet printing (commercial name: Paper customized for Super Fine, available from Seiko Epson Corporation, hereinafter referred to as "medium 5 for recording") was used as a medium for recording in practical example 1, whereby an image print was obtained.

Next, for medium 1 for recording, medium 2 for recording, medium 3 for recording, medium 4 for recording, and medium 5 for recording, the amounts of transferred pure water and cyan ink produced in production example 1 were measured as follows using a dynamic scanning absorptometer. The results are shown in Table 2.

<Measurement of Amounts of Transferred Pure Water and Cyan Ink by Dynamic Scanning Absorptometer>

For each of the recording media, the amounts of transferred pure water and cyan ink were measured at 25° C. and 50% RH using a dynamic scanning absorptometer (K350 series, type D, available from Kyowa Co., Ltd.). The transfer amounts at contact time periods of 100 ms and 400 ms were obtained by interpolating measurement values of transfer amounts measured for contact time periods around each contact time period.

TABLE 2

| | | Pure water | | Ink of production example 1 (γ = 25) | |
|---|---|---|---|---|---|
| | | Contact time: 100 ms | Contact time: 400 ms | Contact time: 100 ms | Contact time: 400 ms |
| Practical example 1 | Medium 1 for recording | 10.1 ml/m$^2$ | 20.2 ml/m$^2$ | 7.2 ml/m$^2$ | 14.8 ml/m$^2$ |
| Practical example 2 | Medium 2 for recording | 25.2 ml/m$^2$ | 28.5 ml/m$^2$ | 14.6 ml/m$^2$ | 19.4 ml/m$^2$ |
| Practical example 3 | Medium 3 for recording | 10.4 ml/m$^2$ | 21.8 ml/m$^2$ | 6.4 ml/m$^2$ | 8.8 ml/m$^2$ |
| Comparison example 1 | Medium 4 for recording | 2.8 ml/m$^2$ | 3.4 ml/m$^2$ | 2.7 ml/m$^2$ | 3.1 ml/m$^2$ |
| Comparison example 2 | Medium 5 for recording | 41.0 ml/m$^2$ | 44.8 ml/m$^2$ | 38.1 ml/m$^2$ | 46.2 ml/m$^2$ |

Next, the beading, bleeding, a spur mark, and glossiness for each of image prints obtained in practical examples 1-3 were evaluated. The results are shown in Table 3.

<Beading>

The degree of beading in a green-color solid image part on each image print was visually observed and evaluated according to the following criteria.

[Evaluation Criteria]

Rank 4: No beading was generated and uniform printing was made.

Rank 3: The generation of slight beading was observed.

Rank 2: The generation of clear beading was observed.

Rank 1: The generation of gross beading was observed.

<Evaluation of Bleeding>

The degree of bleeding of a black character in yellow background was visually evaluated for each image print and evaluated according to the following criteria.

[Evaluation Criteria]

A: No bleeding was generated and clear printing was made.

B: The generation of bleeding was slightly observed.

C: The generation of bleeding was clearly observed.

D: bleeding was generated such that the outline of a character was blurred.

<Evaluation of Spur Mark>

The degree of a spur mark in each image print was visually observed and evaluated according to the following criteria.

[Evaluation Criteria]

A: No spur mark was observed.

B: A spur mark was slightly observed.

C: A spur mark was clearly observed.

D: A spur mark was grossly observed.

<Evaluation of Glossiness>

The 60° mirror plane glossiness (JIS Z8741) of a cyan-color solid image part of each image print was measured.

TABLE 3

| | Beading | Bleeding | Spur mark | Glossiness of image part |
|---|---|---|---|---|
| Practical example 1 | 3 | B | B | 29.4 |
| Practical example 2 | 4 | A | A | 27.8 |
| Practical example 3 | 3 | B | B | 22.3 |
| Comparison example 1 | 1 | C | D | 32.1 |
| Comparison example 2 | 4 | A | A | 1.7 |

From the results in Table 3, an evaluation result was found such that beading suppression, bleeding suppression, the absence of a spur mark, and a high glossiness could be simultaneously attained at high levels for practical examples 1-3 compared to comparison examples 1 and 2 in which practical examples an ink containing at least water, a coloring agent and a wetting agent and having a surface tension of 20-35 mN/m at 25° C. was combined with a medium for recording in which the amount of ink transferred into the medium for recording for a contact time of 100 ms was 4-15 ml/m$^2$ and the amount of ink transferred into the medium for recording for a contact time of 400 ms was 7-20 ml/m$^2$ which amounts were measured by a dynamic scanning liquid absorption meter.

[Appendix]

Typical embodiments (1) to (33) of the present invention are described below.

Embodiment (1) is a liquid ejecting head with a nozzle forming member in which plural nozzle sequences formed by aligning nozzles configured to eject a liquid drop of recording liquid are arranged such that nozzles of respective sequences are provided in a zigzag pattern and a water-repellent layer comprising a resin layer is applied and formed on a surface thereof at a side of liquid drop ejection, characterized in that the respective nozzle sequences are arranged at an interval(s) which is/are not greater than a diameter of a nozzle.

Embodiment (2) is the liquid ejecting head according to embodiment (1) above, characterized in that each resin layer is formed by coat-scanning an outer side of each nozzle sequence.

Herein, the coat-scanning means to move a coating device relative to a nozzle forming member for coating application.

Embodiment (3) is a liquid ejecting head with a nozzle forming member in which plural nozzle sequences formed by aligning nozzles configured to eject a liquid drop of recording liquid are arranged and a water-repellent layer comprising a resin layer is applied and formed on a surface thereof at a side of liquid drop ejection, characterized in that the respective nozzle sequences are arranged at an interval(s) which is/are equal to or greater than 100 μm.

Embodiment (4) is the liquid ejecting head according to embodiment (3) above, characterized in that the resin layer is formed by coat-scanning an outer side of each nozzle sequence and a space between nozzle sequences.

Embodiment (5) is the liquid ejecting head according to any of embodiments (1) to (4) above, characterized in that the resin layer is applied by a dispenser.

Embodiment (6) is the liquid ejecting head according to any of embodiments (1) to (5) above, characterized in that a thickness of the resin layer is not greater than 10 μm.

Embodiment (7) is the liquid ejecting head according to any of embodiments (1) to (6) above, characterized in that the resin layer comprises a fluorine-containing resin material.

Embodiment (8) is the liquid ejecting head according to any of embodiments (1) to (6) above, characterized in that the resin layer comprises a resin material which comprises a silicone resin.

Embodiment (9) is the liquid ejecting head according to any of embodiments (1) to (8) above, characterized in that a substrate of the nozzle forming member on which the resin layer is applied is formed by a metal material.

Embodiment (10) is the liquid ejecting head according to any of embodiments (1) to (9) above, characterized in that a substrate of the nozzle forming member on which the resin layer is applied is formed by a resin material.

Embodiment (11) is a method of manufacturing a liquid ejecting head according to any of embodiments (1) to (10) above, characterized in that a resin layer is applied on the nozzle forming member in atmosphere.

Embodiment (12) is the method of manufacturing a liquid ejecting head according to embodiment (11) above, characterized in that the resin layer is applied by a dispenser.

Embodiment (13) is an image forming apparatus with a liquid ejecting head configured to eject a liquid drop of recording liquid, characterized by comprising a liquid ejecting head according to any of embodiments (1) to (10) above.

Embodiment (14) is the image forming apparatus according to embodiment (13) above, characterized in that the recording liquid is a recording liquid with a surface tension of 15 to 30 mN/m.

Embodiment (15) is the image forming apparatus according to embodiment (13) or (14) above, characterized in that the recording liquid is a recording liquid containing a fluorine-containing compound.

Embodiment (16) is the image forming apparatus according to any of embodiments (13) to (15) above, characterized in that the recording liquid is a recording liquid containing a pigment as a coloring material.

Embodiment (17) is a liquid drop ejecting device configured to eject a liquid drop from a liquid ejecting head, characterized by comprising a liquid ejecting head according to any of embodiments (1) to (10) above.

Embodiment (18) is a recording method characterized in that recording is performed on a recording medium by ejecting a liquid drop of recording liquid from a liquid ejecting head according to any of embodiments (1) to (10) above.

Embodiment (19) is the recording method according to embodiment (18) above, characterized in that the recording medium is a medium for recording which has a supporter and a coating layer on at least one face of the supporter.

Embodiment (20) is the recording method according to embodiment (18) or (19) above, characterized in that an amount of the recording liquid transferred to the recording medium for a contact time period of 100 ms is 4-15 ml/m$^2$ and an amount of the recording liquid transferred to the recording medium for a contact time period of 400 ms is 7-20 ml/m$^2$ which amounts are measured at 23° C. and 50% RH and by a dynamic scanning liquid absorption meter.

Embodiment (21) is the recording method according to embodiment (18) or (19) above, characterized in that an amount of pure water transferred to the recording medium for a contact time period of 100 ms is 4-26 ml/m$^2$ and an amount of pure water transferred to the recording medium for a contact time period of 400 ms is 5-29 ml/m$^2$ which amounts are measured at 23° C. and 50% RH and by a dynamic scanning liquid absorption meter.

Embodiment (22) is the recording method according to embodiment (18) above, characterized in that the recording medium comprises at least a substrate and a coating layer and an amount of an adhering solid content in the coating layer is 0.5-20.0 g/m$^2$.

Embodiment (23) is the recording method according to embodiment (18) above, characterized in that a weight of the recording medium is 50-250 g/m$^2$.

Embodiment (24) is the recording method according to embodiment (18) above, characterized in that the recording medium is supercalendared.

Embodiment (25) is the recording method according to any of embodiments (18) to (24) above, characterized in that the recording medium contains a pigment and the pigment is kaolin.

Embodiment (26) is the recording method according to any of embodiments (18) to (24) above, characterized in that the recording medium contains a pigment and the pigment is heavy calcium carbonate.

Embodiment (27) is the recording method according to any of embodiments (18) to (26) above, characterized in that the recording medium contains an aqueous resin.

Embodiment (28) is the recording method according to embodiment (27) above, characterized in that the aqueous resin is a water-soluble resin or a water-dispersive resin.

Embodiment (29) is the recording method according to any of embodiments (18) to (28) above, characterized in that the recording liquid contains, at least, water, a coloring agent, and a wetting agent.

Embodiment (30) is the recording method according to any of embodiments (18) to (31) above, characterized in that a surface tension of the recording liquid at 25° C. is 15-40 mN/m.

Embodiment (31) is the recording method according to any of embodiments (18) to (30) above, characterized in that the recording liquid contains a dispersive coloring agent as a coloring agent and an average particle diameter of the dispersive coloring agent is 0.01-0.16 μm.

Embodiment (32) is the recording method according to any of embodiments (18) to (31) above, characterized in that a viscosity of the recording liquid at 25° C. is 1-30 mPa·sec.

Embodiment (33) is the recording method according to any of embodiments (18) to (32) above, characterized in that the recording liquid contains a surfactant and the surfactant is a fluorine-containing surfactant.

According to a liquid ejecting head of at least one typical embodiment described above, a resin layer is formed by only coat-scanning an out side of each nozzle sequence whereby the resin layer can be applied, including between nozzle sequences, and therefore, a coating process can be simplified and cost down can be attained, since plural nozzle sequences formed by aligning nozzles configured to eject a liquid drop of recording liquid are arranged such that nozzles of respective sequences are provided in a zigzag pattern and the respective nozzle sequences are arranged at an interval(s) which is/are not greater than a diameter of a nozzle.

According to a liquid ejecting head of at least one typical embodiment described above, a resin layer can be formed by coat-scanning an outer side of each nozzle sequence and/or between nozzle sequences, so that a coating process can be simplified and cost down can be attained, since plural nozzle sequences formed by aligning nozzles configured to eject a liquid drop of recording liquid are arranged at an interval(s) which is/are equal to or greater than 100 μm.

According to a method of manufacturing a liquid ejecting head of at least one typical embodiment described above, a resin layer constituting a water-repellent layer can be easily formed with low cost, since a resin layer is applied and formed on the nozzle forming member in atmosphere.

According to an image forming apparatus of at least one typical embodiment described above or a liquid drop ejecting device of at least one typical embodiment described above, cost down can be attained, since a liquid ejecting head of at least one typical embodiment described above is included.

According to a recording method of at least one typical embodiment described above, a high quality image can be recorded, since recording is performed by ejecting a liquid drop from a liquid ejecting head of at least one typical embodiment described above.

The embodiment(s) of the present invention can be applied to a liquid ejecting head and a method of manufacturing the same, an image forming apparatus, a liquid drop ejecting device, and a recording method, in particular, a liquid ejecting head having a surface with a water repellency, a method of manufacturing the same, and an image forming apparatus, liquid drop ejecting device, and recording method with a liquid ejecting head.

The present invention is not limited to the specifically disclosed embodiment(s) and variations and/or modifications may be made in the embodiment(s) without departing from the scope of the present invention.

The foreign priority of the present application is claimed which is based on Japanese patent application No. 2005-338130 filed on Nov. 24, 2005 and the Japanese patent application No. 2006-025085 filed on Feb. 1, 2006, the entire contents of which applications are hereby incorporated by reference.

What is claimed is:

1. A liquid ejecting head with a nozzle forming member in which plural nozzle sequences formed by aligning nozzles configured to eject a liquid drop of recording liquid are arranged such that nozzles of respective sequences are provided in a zigzag pattern and a water-repellent layer comprising a coat-scanned resin layer is applied and formed on a surface thereof at a side of liquid drop ejection, wherein the respective nozzle sequences are arranged at an interval(s) which is/are not greater than a diameter of a nozzle, and wherein the thickness of the coat-scanned resin layer gradually increases toward a periphery of each of the nozzles.

2. The liquid ejecting head as claimed in claim 1, wherein the resin layer is applied by a dispenser.

3. The liquid ejecting head as claimed in claim 1, wherein a thickness of the resin layer is not greater than 10 μm.

4. The liquid ejecting head as claimed in claim 1, wherein the resin layer comprises a fluorine-containing resin material.

5. The liquid ejecting head as claimed in claim 1, wherein the resin layer comprises a resin material which comprises a silicone resin.

6. The liquid ejecting head as claimed in claim 1, wherein a substrate of the nozzle forming member on which the resin layer is applied is formed by a metal material.

7. The liquid ejecting head as claimed in claim 1, wherein a substrate of the nozzle forming member on which the resin layer is applied is formed by a resin material.

8. The liquid ejecting head as claimed in claim 1, wherein each resin layer is formed by coat-scanning an outer side of each nozzle sequence in a predetermined direction.

9. The liquid ejecting head as claimed in claim 1, wherein each resin layer is formed by:

a first coat scanning sequence including coat scanning a first outer side of a first nozzle sequence in a first predetermined direction; and a second coat scanning sequence including coat scanning a second outer side of a second nozzle sequence in a second predetermined direction different from the first predetermined direction.

10. The liquid ejecting head as claimed in claim 1, wherein a liquid drop of the recording liquid is ejected from the nozzle in a first direction that is perpendicular to a second direction that is a direction of flow of the recording liquid within the liquid ejecting head.

11. The liquid ejecting head as claimed in claim 1, wherein for each of the respective nozzle sequences the nozzles are arranged at intervals equal to the diameter of the nozzles.

12. A liquid ejecting head with a nozzle forming member in which plural nozzle sequences formed by aligning nozzles configured to eject a liquid drop of recording liquid are arranged and a water-repellent layer comprising a coat-scanned resin layer is applied and formed on a surface thereof at a side of liquid drop ejection, wherein the respective nozzle sequences are arranged at an interval(s) which is/are equal to or greater than 100 μm, and wherein the thickness of the coat-scanned resin layer gradually increases toward a periphery of each of the nozzles.

13. The liquid ejecting head as claimed in claim 12, wherein the resin layer is formed by coat-scanning the outer side of each nozzle sequence and a space between nozzle sequences.

14. An image forming apparatus with a liquid ejecting head configured to eject a liquid drop of recording liquid, which comprises a liquid ejecting head with a nozzle forming member in which plural nozzle sequences formed by aligning nozzles configured to eject a liquid drop of recording liquid are arranged such that nozzles of respective sequences are provided in a zigzag pattern and a water-repellent layer comprising a coat-scanned resin layer is applied and formed on a surface thereof at a side of liquid drop ejection, wherein the respective nozzle sequences are arranged at an interval(s) which is/are not greater than a diameter of a nozzle, and wherein the thickness of the coat-scanned resin layer gradually increases toward a periphery of each of the nozzles.

15. The image forming apparatus as claimed in claim 14, wherein the recording liquid is a recording liquid with a surface tension of 15 to 30 mN/m.

16. The image forming apparatus as claimed in claim 14, wherein the recording liquid is a recording liquid containing a fluorine-containing compound.

17. The image forming apparatus as claimed in claim 14, wherein the recording liquid is a recording liquid containing a pigment as a coloring material.

* * * * *